US012497212B1

(12) United States Patent
Gilbert

(10) Patent No.: US 12,497,212 B1
(45) Date of Patent: Dec. 16, 2025

(54) HOLDER FOR CONTAINERS IN THE FORM OF A FRAME

(71) Applicant: Daniel Paul Scott Gilbert, Karmiel (IL)

(72) Inventor: Daniel Paul Scott Gilbert, Karmiel (IL)

( * ) Notice: Subject to any disclaimer, the term of this patent is extended or adjusted under 35 U.S.C. 154(b) by 0 days.

(21) Appl. No.: 19/232,936

(22) Filed: Jun. 10, 2025

Related U.S. Application Data

(63) Continuation of application No. 29/987,904, filed on Jan. 28, 2025, and a continuation-in-part of application No. 19/040,889, filed on Jan. 30, 2025, and a continuation-in-part of application No. 29/988,102, filed on Jan. 30, 2025.

(60) Provisional application No. 63/754,918, filed on Feb. 6, 2025, provisional application No. 63/756,208, filed on Feb. 9, 2025.

(51) Int. Cl.
*B65D 1/38* (2006.01)
*B65D 21/02* (2006.01)

(52) U.S. Cl.
CPC ..... *B65D 21/0233* (2013.01); *B65D 2203/02* (2013.01)

(58) Field of Classification Search
CPC ..... B65D 1/38; B65D 1/34; B65D 1/22
See application file for complete search history.

(56) References Cited

U.S. PATENT DOCUMENTS 7,823,728 B2 11/2010 Baltz
9,131,770 B2 9/2015 Stegherr
9,376,232 B2 6/2016 Joy
9,596,931 B1 * 3/2017 Nimgulkar ..... A47B 88/49
10,238,224 B1 * 3/2019 Nazarian ..... B65D 1/38
10,308,409 B2 6/2019 Stuart et al.
10,472,129 B2 11/2019 Meers et al.
10,913,573 B2 2/2021 Englert et al.
11,535,416 B2 12/2022 Swartz et al.
11,634,252 B2 4/2023 Robinson et al.
11,794,940 B2 10/2023 Liming et al.
11,889,949 B2 2/2024 Casey et al.
(Continued)

OTHER PUBLICATIONS

Borosil, Klip N Store Plus Rectangular Glass Container, Apr. 26, 2025 https://myborosil.com/collections/klip-n-store-containers?srsltid=AfmBOoo1ROAe90_Wect3zpYpR7W5YW3b3YnaXsVsV8sYsArCyqcNJje8.
(Continued)

*Primary Examiner* — Stephen J Castellano
(74) *Attorney, Agent, or Firm* — Shlomo Horowitz; Shlomo HOROWITZ Patents and Intellectual Property

(57) ABSTRACT

A holder of nestable containers such as food containers in the form of a frame has walls including a bottom wall and at least one sloping wall that is a side wall. One of the walls has a cut-out, transparent window and/or decoration layer. In any wall having a cut-out the cut-out occupies at least a certain percentage of the surface area of the wall. The one or more cut-outs or transparent window may be shaped (a) to define a source identifier associated with the holder and (b) to allow a user to view contents of the food container held by the holder. The cut-outs may be surrounded by solid portions of the wall that it is cut out of. The size of the holder may match the size of the container(s) that the holder holds. The holders are stackable and can be hung through the aligned cut-outs.

24 Claims, 36 Drawing Sheets

(56) References Cited

U.S. PATENT DOCUMENTS

| | | | | |
|---|---|---|---|---|
| 12,110,153 | B1 | 10/2024 | Robertson | |
| 2018/0000551 | A1* | 1/2018 | Wahib | A61B 50/20 |
| 2018/0008102 | A1* | 1/2018 | Engell | A47K 3/281 |
| 2024/0067398 | A1* | 2/2024 | Kennedy | B65D 25/20 |

OTHER PUBLICATIONS

Joybos, Multifunctional Fridge Timer Control Storage Containers, Apr. 26, 2025 https://www.youtube.com/shorts/3H7loVIYG3c.

Hago Store, Fridge Storage Boxes, Apr. 26, 2025 https://www.amazon.in/Hago-Containers-Container-Vegetable-Refrigerator/dp/B0CQ1XDP1T?th=1.

* cited by examiner

HOLDER FOR CONTAINERS IN THE FORM OF A FRAME

FIELD OF THE INVENTION

The invention is in the field of holders for containers, for example containers of plastic or of other materials, for example methods and apparatuses for preparing and presenting salads and other foods or drink in an enhanced and more efficient manner, for example for festive meals for significant numbers of people.

BACKGROUND OF THE INVENTION

When a salad is purchased for a festive meal, it typically is purchased in a plastic container. Many different types of salads, for example ten or fifteen, may be purchased for the meal, thus resulting in many different plastic containers. This is because the host wants to satisfy the different palates of the guests. Accordingly, each container may be relatively small and the host may prefer to offer fifteen different types of salads rather than one or two large containers of salads.

Normally, in order to present the contents of the plastic containers to those partaking of the meal, which may a large number of people, it is necessary transfer each of the salads or other foods into appropriate presentable bowls or other culinary utensils. Many people transfer the salads or other foods into semi-rigid plastic semi-elegant containers which they then discard after use. Whether they do this or transfer them to regular dishes, for those who regularly, for example weekly, prepare festive meals for significant numbers of people, this is a time-consuming and burdensome task each time it is executed. Yet to dispense with this step and keep the salads in their original purchased containers would degrade the elegance of the festive meal.

Other foods and items need to be presented in an elegant but efficient manner.

SUMMARY OF THE EMBODIMENTS

One embodiment is a holder configured to nestably hold a container, comprising: walls including

- a bottom wall with at least one cut-out;
- at least one sloping side wall that slopes from a top of the holder to a bottom of the holder so as to narrow the holder from the top to the bottom;
- wherein the bottom wall or the at least one sloping side wall includes one or more cut-outs, or one or more transparent windows, that are configured to allow a user to see a content of the container,
- wherein at least one of the one or more cut-outs or of the transparent windows is shaped to define a first source identifier,
- wherein a size of the holder matches a size of the container such that the holder is configured to hold the container nesting inside the holder.

In some embodiments, the bottom wall or the at least one sloping side wall has the one or more cut-outs. In some embodiments, the holder has one or more cut-outs and wherein two of the one or more cut-outs are in the bottom wall and are separated from one another, wherein a portion of each of the two bottom cut-outs borders the at least one sloping side wall. In some embodiments, each of the two bottom cut-outs are configured to receive a thumb of a user pressed against a bottom of the container so as to eject the container when the container is nestably held within the holder. In some embodiments, each of the two bottom cut-outs are configured to receive a thumb of a user so as to allow the user to grasp and carry a stack of the holders. In some embodiments, one of the one or more cut-outs is in the at least one sloping side wall and is surrounded by a solid portion of the at least one sloping side wall.

In some embodiments, the at least one sloping side wall or the bottom wall also includes a decoration layer that includes a label or graphic on a surface of, or embedded into a surface of, the at least one sloping wall. In some embodiments, the decoration layer includes one of the one or more transparent windows.

In some embodiments, the holder further comprises an area adjacent the decoration layer or included in the decoration layer is indented relative to a surface of the at least one sloping side wall or of the bottom wall.

In some embodiments, the decoration layer includes the first source identifier or another source identifier.

In some embodiments, the bottom wall or the one or more sloping side walls includes the one or more transparent windows.

In some embodiments, the at least one sloping side wall is colored with one of the following elegant colors: silver, gold, rose gold, platinum, pure white, pure black, charcoal gray, ivory, cream, navy blue, burgundy, deep plum, blue, purple and violet.

In some embodiments, the bottom wall or the one or more sloping side walls includes the one or more cut-outs and wherein at least one of the one or more cut-outs is shaped to define the source identifier.

In some embodiments, the bottom wall or the one or more sloping side walls includes the one or more cut-outs and wherein at least one of the one or more cut-outs on the at least one sloping side wall is shaped to define the source identifier.

In some embodiments, the bottom wall or the one or more sloping side walls includes the one or more cut-outs and wherein each of the cut-outs of the one or more cut-outs is shaped to define the source identifier.

In some embodiments, the bottom wall or the one or more sloping side walls includes the one or more cut-outs and wherein each cut-out of the one or more cut-outs on the at least one sloping side wall is surrounded by a solid portion of one of the walls.

In some embodiments, the bottom wall or the one or more sloping side walls includes the one or more cut-outs and wherein each particular cut-out of the one or more cut-outs occupies at least 25% of a surface area of a particular wall of the walls that the particular cut-out is cut out of.

In some embodiments, the bottom wall or the one or more sloping side walls includes the one or more cut-outs and wherein at least one of the one or more cut-outs is situated in the bottom wall and at least one of the one or more cut-outs is situated in the at least one sloping side wall.

In some embodiments, the bottom wall or the one or more sloping side walls includes the one or more cut-outs and wherein at least one of the one or more cut-outs is shaped as a single crown or as a double crown.

In some embodiments, the sloping side wall slopes at an angle of up to 25 degrees to a vertical axis orthogonal to the bottom wall.

In some embodiments, the at least one sloping walls slope nonlinearly.

In some embodiments, the at least one sloping side wall has one or more of the cut-outs configured to receive a handle of the container.

In some embodiments, the at least one sloping side wall comprises a wall extension extending upwardly above a top rim of the holder, and wherein the wall extension includes at least one of the one or more cut-outs or transparent windows or the decoration layer.

In some embodiments, the bottom wall has an indentation configured to snugly receive a bottom of a container.

In some embodiments, the one or more cut-outs include one or both of the following:

(i) multiple identical cut-outs cut out of one of the walls, (ii) an alphanumeric character, single or double crowns, a heart, a diamond, a celestial object, a human or animal figure, a flower, a dollar sign.

Another embodiment is a combination comprising the holder in any of the embodiments described herein and further comprising the container nesting inside the holder.

In some embodiments, the holder is configured to hold a first nestable container and a second nestable container side by side such that each of the first and second nestable containers has three sides that fit snugly with one of the at least one sloping side walls of the holder.

Another embodiment is a holder configured to nestably hold a container, comprising:

walls including a bottom wall;

wherein a first wall of the walls includes one or more cut-outs configured to allow a user to see a contents of the container, wherein the first wall or a second wall of the walls includes a decoration layer that includes a label or graphic on a surface of, or embedded into a surface of, the first wall or the second wall, wherein an internal dimensions of the holder matches external dimensions of the container.

In some embodiments, the decoration layer comprises a source identifier associated with the holder or one of the cut-outs is shaped to define the source identifier associated with the holder.

Another embodiment is a stack of nestable holders, each of the holders configured to hold a nestable container, the stack comprising:

a series of the at least three holders, wherein each holder in the series comprises:

a bottom wall;

at least one sloping side wall;

wherein the bottom wall has a cut-out that occupies a majority of a surface area of the bottom wall, the cut-out shaped so as (a) to define a source identifier associated with the holder and (b) to allow a user to view contents of one of the containers held by any of the holders, wherein the cut-outs in the walls of the holders in the stack are aligned such that the stack as a whole is configured to be hung by the cut-outs on an element projecting from a wall, the wall and the element not part of the stack, such that the source identifier can be advertised to onlookers while the stack is hung.

BRIEF DESCRIPTION OF THE DRAWINGS

Various embodiments are herein described, by way of example only, with reference to the accompanying drawings, wherein.

DETAILED DESCRIPTION OF THE EMBODIMENTS

Figure 1:
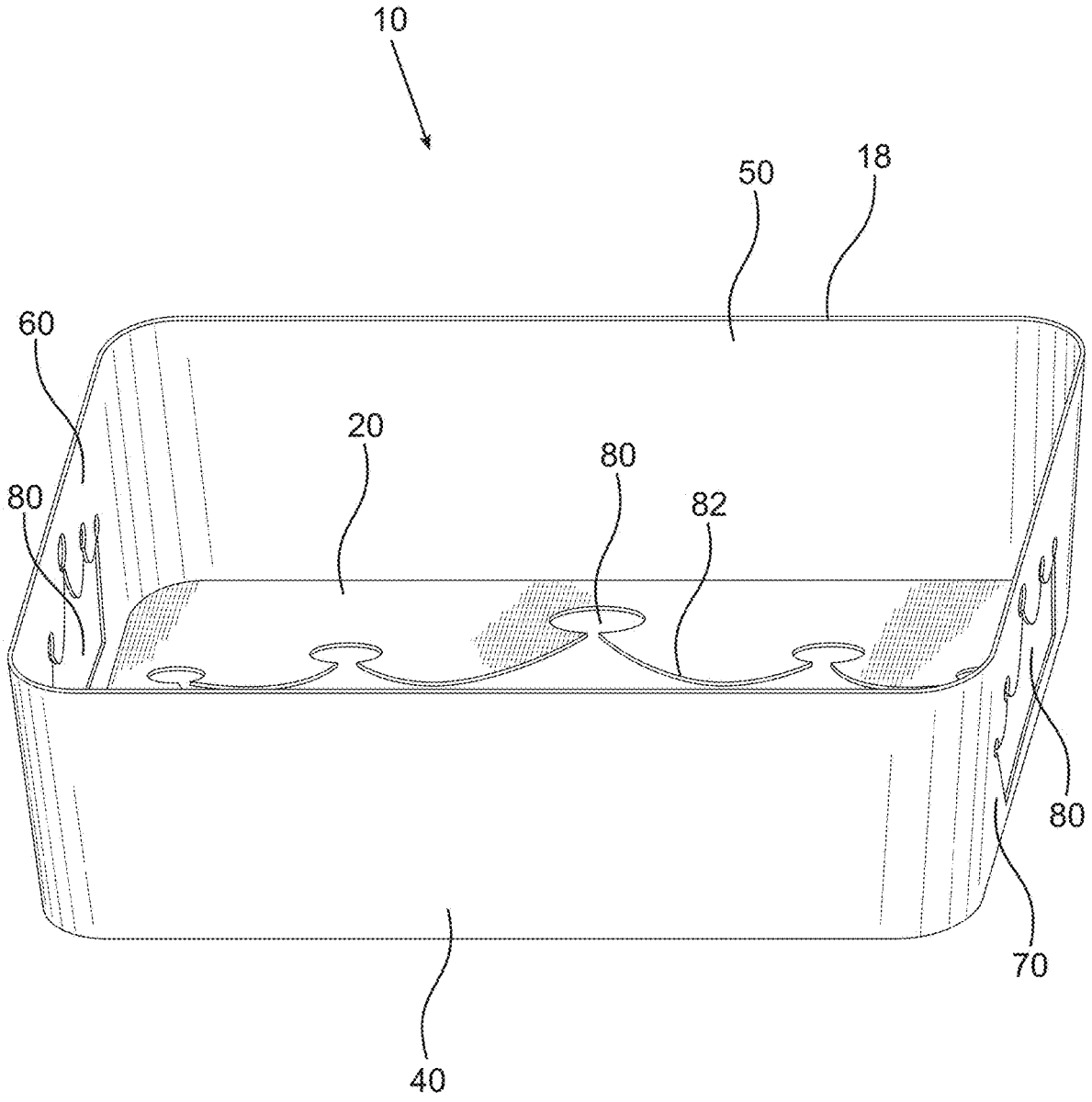
FIG. 1 is a perspective view of a substantially rectangular holder for a food container, in accordance with one embodiment.
Figure 2:
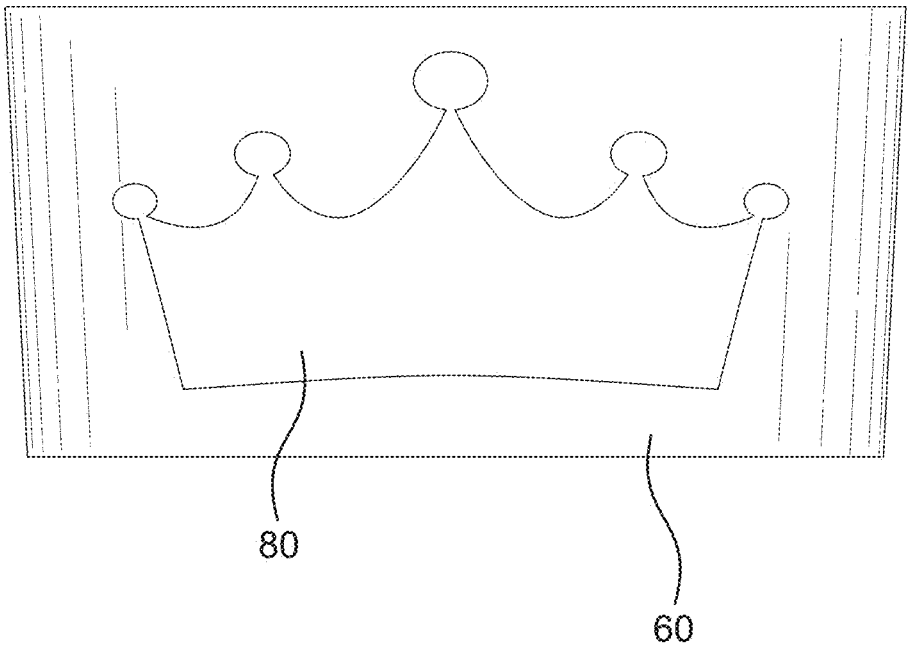
FIG. 2 is a front view of the holder of FIG. 1, in accordance with one embodiment.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Applicant has discovered that it is possible to save time and effort, to enhance the presentation of the salads and other foods and to reduce plastic waste.

Certain embodiments generally provide a holder for food containers, the holder comprising a frame in which the food container sits. Generally, the size of the holder matches the size of the food container that it holds. The food containers themselves may be of the type that are nestable one within the other such that the food container also nests within the holder and also such that a stack of holders nests one within the other.

In any embodiment, the holder may be elegant as a result of the color of the walls and/or the presence on or in the wall or walls of: a decoration layer that is decorative in shape or content and/or one of or more cut-outs or transparent windows that are decorative in shape.

The holder may comprise a bottom wall and at least one side wall. The side wall may be sloping (i.e. wider at the bottom). If the holder is round then the side wall is a round side wall. If the holder is rectangular or square (or another shape) then its side walls may include a front, rear, left and right side wall.

The holder may have at least one cut-out. In some embodiments, the cut-out is large enough that the remainder of the wall is essentially a frame. The cut-out may be situated on the bottom, on a side wall, on both the bottom and one or more side walls or only on the side walls or some of the side walls. The one or more cut-outs may be shaped (a) to define a source identifier associated with the holder and (b) to allow a user to view contents of one of the food containers held by the holder. This provides a way of enhancing the presentation of the salads or other food in the food containers without transferring the food contents into regular china or other elegant dishes. In addition, elegant decorative coverings such as color coded coverings may be made and placed on the remainder of the side walls of the holder. In some embodiments, the existence of the cut-out in the shape of a source identifier or logo makes it more elegant and encourages further transformations involving adding two-dimensional graphically elegant wrappings of the non-cutout portions of the side walls or bottom wall. In one non-limiting example, a crown-shaped conveys the impression of something exalted.

The holders may be made from plastic in any embodiment. However, in other implementations, the holder may be made of metal or a wide range of other materials. In some embodiments, the holder is silver-plated or gold-plated.

The holder may be stacked such that the bottom cut-outs are aligned and thereby used to hang the stack on something protruding from a wall of a room.

The holders are reusable.

The holders are configured for preparing and presenting salads and other foods in an enhanced and more efficient manner, for example for festive meals for significant numbers of people.

However, in some embodiments, the holders are configured for holding non-food items such as plant pots.

In some embodiments, the side cut-outs can be used for hanging stacks of the holders.

The holder may have a transparent window instead of or in addition to one- or more cut-outs. In some embodiments, the side wall has at least one cut-out (or transparent window) whose surface area taken alone is at least 20%, or at least 25% or at least 30% or at least 35% or at least 40% or at least 45% or at least 50% or at least two thirds of the surface area of the entire side wall (or bottom wall) from which it is cut out of (if the holder is rectangular and has multiple side walls).

If the holder is a frustoconical shape (i.e. "round") then in some embodiments the wall surface area from which the above percentage (the percentage of the surface area that the cut-out represents of the total surface area of the wall from which is it cut-out of) is measured would be the 180 degrees of side wall, meaning half the round side wall.

The principles and operation of a Holder for Containers in the Form of a Frame may be better understood with reference to the drawings and the accompanying description.

As shown in FIG. 1, one embodiment is a holder 10 of containers such as plastic food containers (not shown) is in the form of a frame as a result of one or more cut-outs in the walls of the holder 10. If the cut-outs occupy a significant enough portion of the surface area of the particular wall from which the particular cut-out is cut out of, then that particular wall is rendered a frame for the container that the holder hold and the food container therein The food containers held by the holders 10 herein may be nestable. In addition, in some embodiments, each of the holders 10 may be nestable or stackable in other holders 10 (of the same size or model). In some embodiments, holder 10 has no internal wall that obstructs placement of another holder 10 on top of it so as to nest snugly within it.

The term "stackable" as used herein is used synonymously with the word nestable to denote that a holder 10 sits in the hollow space defined by another holder 10 when it stacks together.

Furthermore, a size and shape of certain portions of the holder 10 may match a size of the corresponding portion of containers, for example plastic containers, for example nestable plastic containers, that the holder 10 holds. The matching portions may for example the bottom portions (of the holder and container). For example, the container, or most of it or some of it, may sit snugly into the hollow space of the inside of the holder 10 defined by the walls 15 of the holder.

In one embodiment, the holder 10 is configured to hold nestable transparent or translucent containers such that the cut-outs 80 in the holder allow a user to see through the holder and see through the container being held by the holder to view the food contents (or enough to identify the contents) inside the container held by the holder 10. Holder 10 may be structured in the form of a frame due to cut-outs in its walls.

Holder 10 includes walls 15. These walls may include a bottom wall 20 and one or more side walls 30 (a single round side wall 30 in the event the holder 10 is substantially round) and side walls 40, 50, 60 and/or 70. It is noted that the "round" version of the holder 10 is actually substantially conical with a truncated apex (i.e. frustoconical), assuming the side walls are sloping from a wider top of the holder 10 to a narrower in diameter bottom of the holder 10. If the side walls are not sloping then holder 10 may be substantially cylindrical.

References in this patent application to a "round" version of the holder 10 itself (as opposed to references to a round bottom wall) refer to either a substantially conical holder 10 with its apex truncated (if the side walls are sloping) as depicted in FIGS. 8-14, or a substantially cylindrical holder 10 (if the side walls are not sloping).

The bottom wall 20 of holder 10 may have a substantially flat surface or a substantially flat portion of the bottom wall 20 so as to ensure stability when resting the holder 10 on a surface, i.e. that holder 10 does not wobble or otherwise move when rested on a flat surface.

Holder 10 includes walls including a bottom wall 20 and at least one side wall (30, 40, 50, 60, 70). If the holder 10 is round then the at least one side wall comprises one round side wall 30, as seen from FIG. 8. If the holder 10 is rectangular or square, or another quadrilateral, or oval then the at least one side wall may comprise a left side wall 40, a right side wall 50, a front wall 60 and a rear wall 70, as shown in FIG. 1 (in the example of a substantially rectangular shape). If the holder is triangular or pentagonal then the at least one side wall may be comprised of three or five side walls, as the case may be, and so on. If the holder 10 is oval, as shown in FIG. 28D, then there may be a front curved wall 60, a rear curved wall 70 and left and right curved side walls 40, 50, each of which represents a portion of the whole wall surrounding the holder 10. In some versions of an oval holder 10 10, the two longer walls (front and rear walls 60, 70) may be straight and only two may be rounded.

Figure 3:
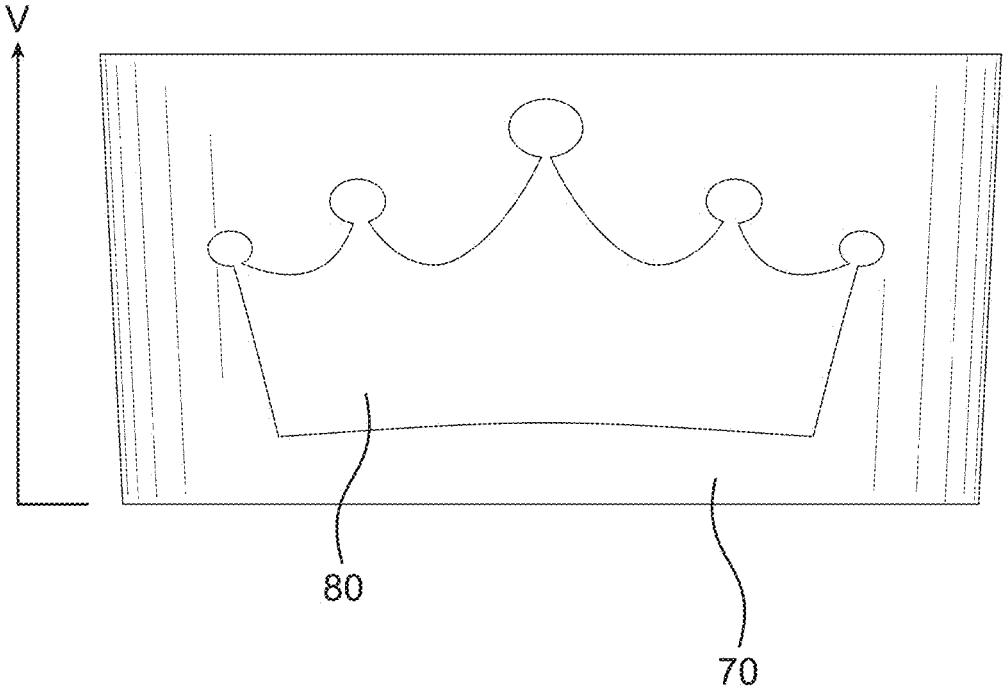
FIG. 3 is a rear view of the holder of FIG. 1, in accordance with one embodiment.
Figure 4:
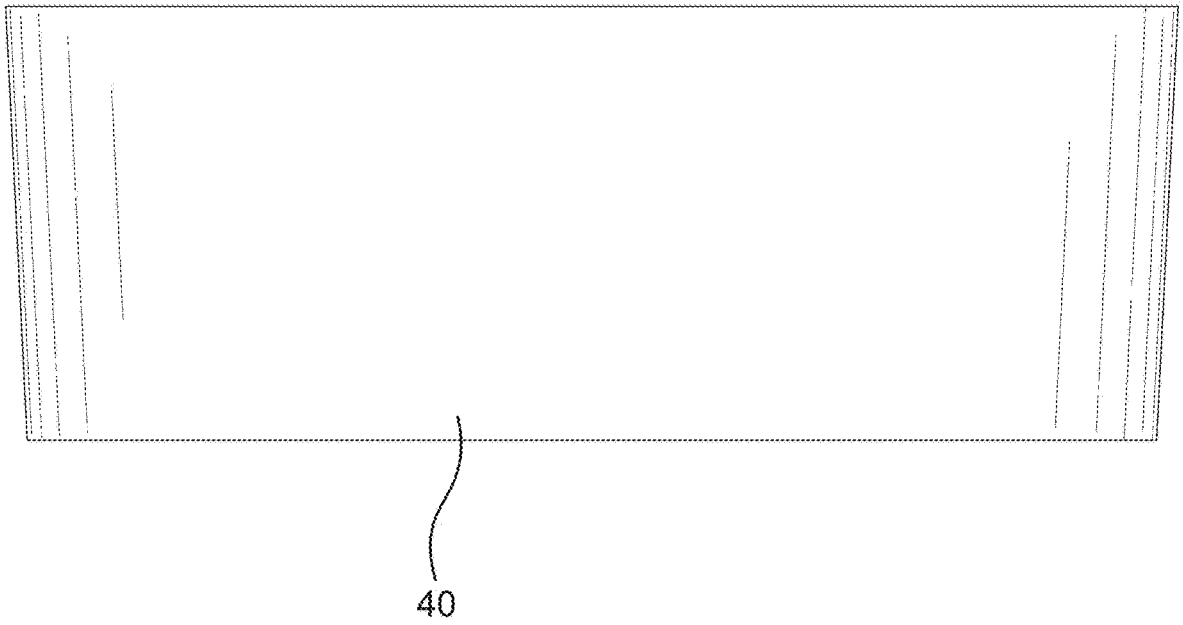
FIG. 4 is a left side view of the holder of FIG. 1, in accordance with one embodiment.
Figure 5:
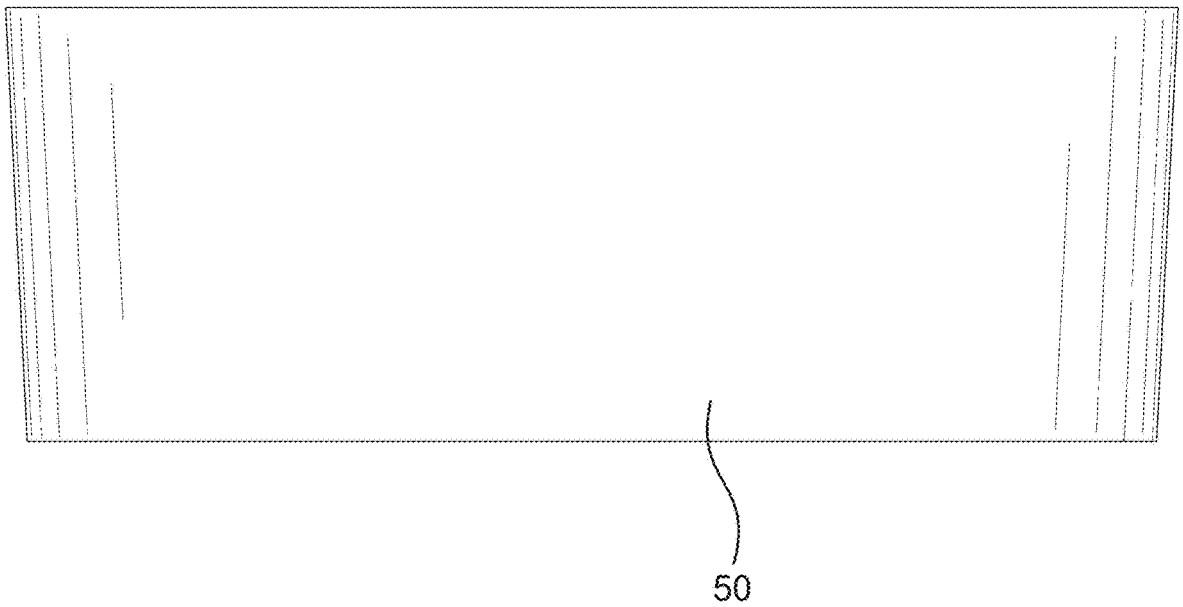
FIG. 5 is a right side view of the holder of FIG. 1, in accordance with one embodiment.

As shown in FIG. 1 through FIG. 5 and FIG. 8 through FIG. 13, these side walls of the at least one side wall may be sloping and the below discussion will refer to the side walls as sloping side walls. The at least one sloping side wall refers to a slope that slopes from a top of the holder to a bottom of the holder. In some embodiments, the slope is such as to narrow the holder 10 as one goes from its top 18 to its bottom 19. The degree of the sloping need not be exactly that shown in the drawings. In some embodiments, the sloping side wall 30 in the case of a round holder like in FIGS. 8-14, or all of the sloping side walls 40, 50, 60, 70, in the case of a rectangular, square or oval shaped holder 10, slopes at an angle of about 5 degrees (or four degrees or three degrees or two degrees or one degree or less than one degree as long as it is still possible to nestably stack the holders 10) to the vertical axis V (FIG. 3). In some embodiments, the sloping side wall slopes at an angle of about 10 degrees to the vertical axis V (FIG. 3).

In another embodiment, the walls 15 of holder 10 do not slope. In such a case, the inside diameter or dimensions of the holder 10 match the external dimensions of the container (not shown) plus any minimal clearance needed, if any. This version (with no sloping) can then be used in any of the implementations described herein for the cut-outs and other features (for example an indentation or a decoration). The word "about" in this patent application means within a deviation of 10%.

In some embodiments, the sloping side wall slopes at an angle of about 15 degrees, or in other embodiments about 20 degrees or in other embodiments about 25 degrees or in other embodiments about 30 degrees or in other embodiments 35 degrees or in other embodiments about 40 degrees or in other embodiments about 45 degrees to a vertical axis V (FIG. 3) orthogonal to the bottom wall.

In general, the slope of the side walls may be substantially linear as shown in FIG. 2, FIG. 3, FIG. 4, FIG. 5, FIG. 9, FIG. 10, FIG. 11 and FIG. 12. In certain embodiments, as in FIG. 27C, the slope of a side wall may be nonlinear, for example curved like the side wall 61, 71 of a bowl.

Furthermore, any feature herein may be combined with any other version of the holder 10. For example, any of the versions of the cut-outs 80 herein may be combined with any of the versions described herein of the different possible shapes and structures of the holder 10.

The bottom corners of holder 10 need not be exactly as shown in FIGS. 1-7 in the case of a substantially rectangular holder 10. For example, as shown in FIG. 26, FIG. 27C, FIG. 31*d*, FIG. 35A, FIG. 36A, FIG. 39, the bottom corners 29 of holder 10 may be more rounded or fully rounded in three dimensions.

In some embodiments, the at least one sloping side wall comprises multiple sloping side walls. In some embodiments, as shown in FIG. 1, 2, 3, 4, 5, 6, 7, for example, the at least one sloping side wall comprises four multiple sloping side walls 40, 50, 60, 70.

The sloping nature of the side wall or side walls allows for the holder 10 to hold the food container snugly and for the holder itself be nestable and stackable. The plastic food container itself (not shown) is one that is nestable and stackable.

The term "snugly" used herein for holder or containers that nest together means they nest together with a friction fit or they nest together.

The size (and general shape such as round versus rectangular) of the holder 10 matches the size (and general shape) of the food container that the holder 10 is designed to hold. This allows the food container to nest within the holder 10. This phrase "nest (or nesting) within the holder or "hold the container nesting within the holder" or the like does not require the entire container to be nesting inside the holder 10 but rather only part of it. In some case it will be a majority of the container but in some case it could be less than a majority and in some case it could be all of the container and in some case it could be all of the container except the top rim of the container or all of the container except the top portion of the container. So this phrase "or the like" does not preclude a scenario in which some part of the container sticks out of the holder 10, for example above the holder 10. The holder 10 may also be used to hold a container that itself has a lid. In some implementations, there could be a special lip 41 on holder 10 that meets the container lid. Alternatively, if the container has a lid and if the holder has no special lip, there could be a small space between the holder wall and the wall of the container (although typically the holder 10 is configured such that the container nests snugly inside holder 10). Furthermore, in some embodiments, the holder 10 itself may have a lid 75 (FIG. 31D).

Figure 29:
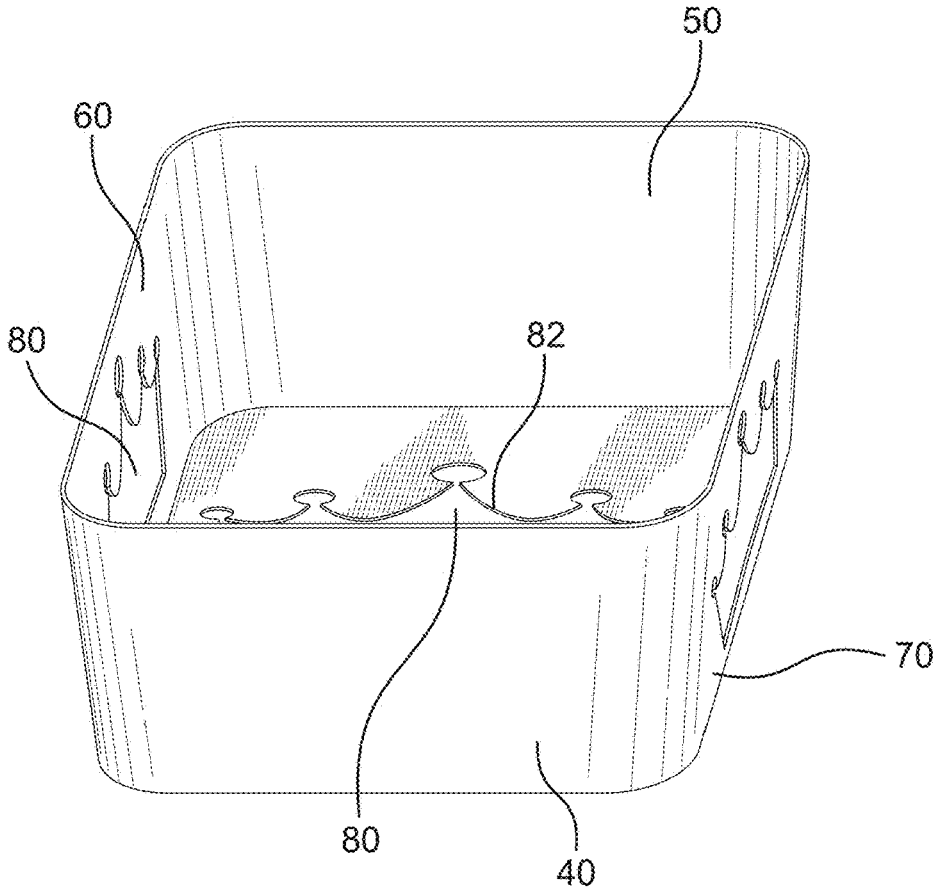
FIG. 29 is a perspective view of a substantially square holder, in accordance with one embodiment.
Figure 30:
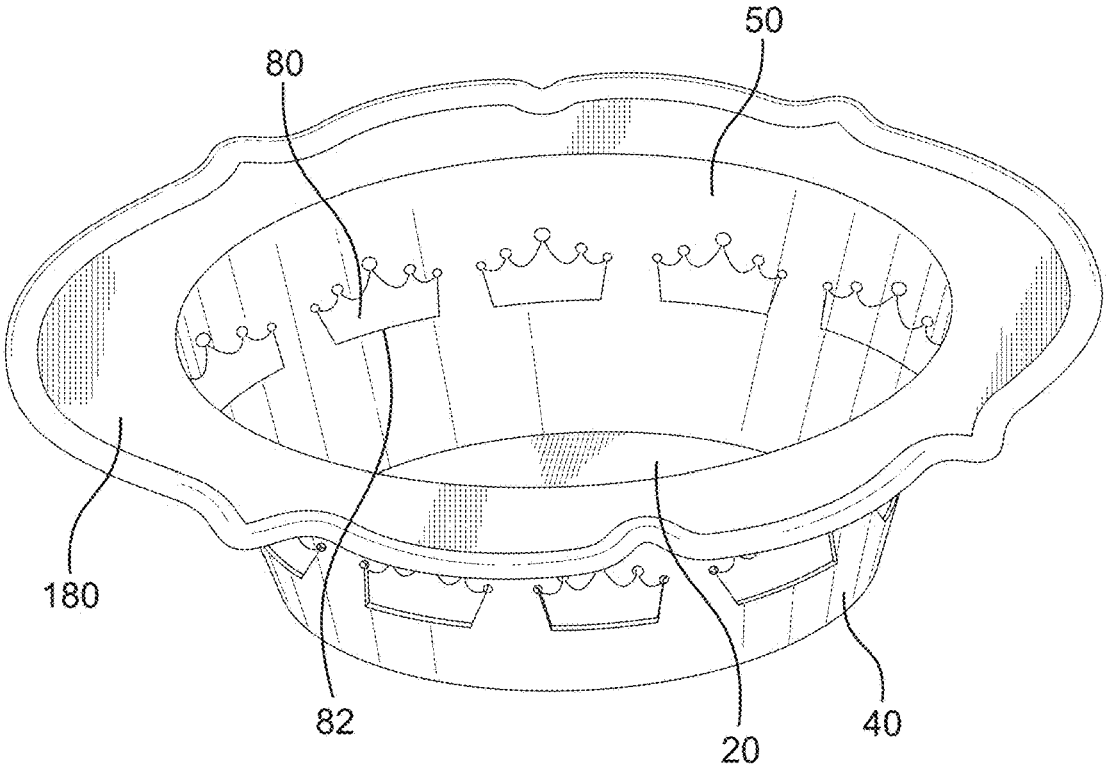
FIG. 30 is a perspective view of a substantially oval holder with a rim, in accordance with one embodiment.
Figure 31A:
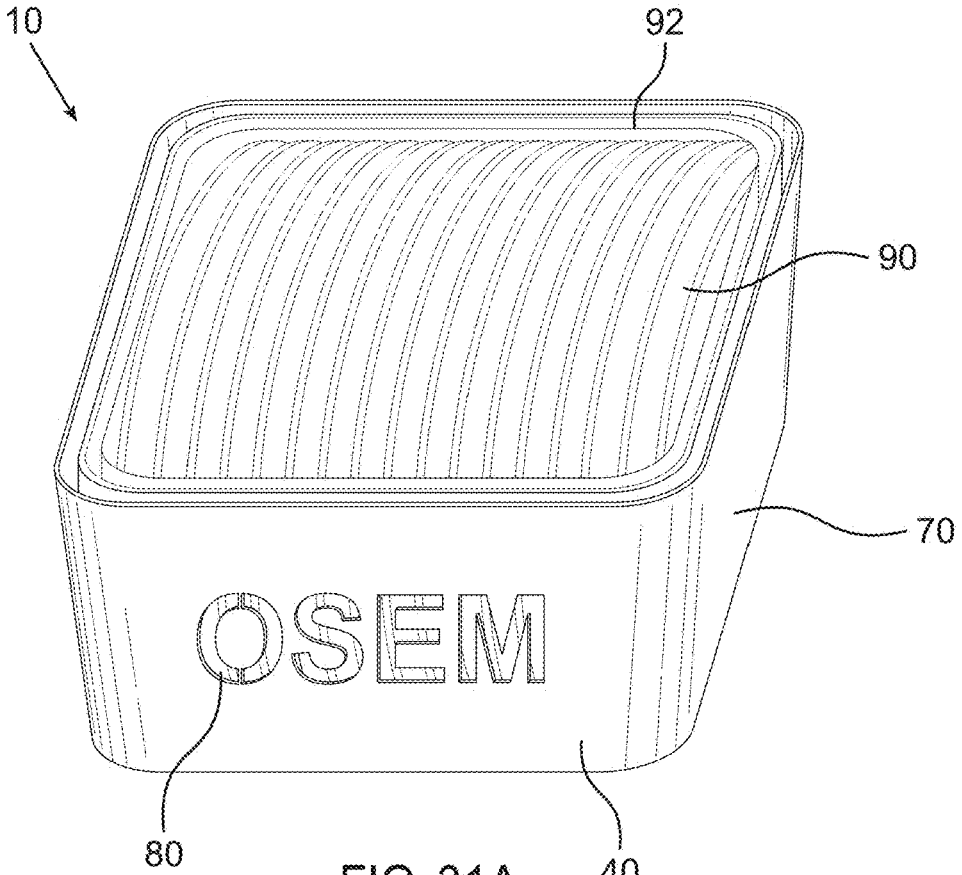
FIG. 31A is perspective view from the top and side of a substantially square holder holding a package of crackers, in accordance with one embodiment.

The holder 10 may be substantially rectangular as in FIGS. 1-7, substantially round (as defined herein) as in FIGS. 8-14, substantially square as in FIG. 29 and FIG. 31A, or substantially oval as in FIG. 30. Typically, when the holder 10 is of a particular overall shape such as substantially rectangular, substantially round (as defined herein), substantially oval or substantially square, the bottom wall 20 of the holder 10 has that shape also. As shown in FIG. 30, the holder 10 may have a brim 180 or flange 180 extending from the top. Although not shown in FIG. 30, the bottom wall 20 (or any of the other walls of the holder 10 shown in FIG. 30 may have a different cut-out 80 than that shown in FIG. 30), in any version, as is shown for other versions such as that shown in FIG. 7, FIG. 14, FIG. 15, FIG. 16A, FIG. 16B, FIG. 18, or any other cut-out (with or without any of the versions of the cut-outs shown in or discussed/described herein).

The holder 10 shown in FIG. 30 is fancy and elegant. In some embodiments, the holder 10 is silver-plated or gold-plated. There are certain regularly recurring festive meals that have religious significance and that require the use of elegant dishware. In order to comply with such requirements efficiently, one can avoid transfer the fifteen salads or other dishes that are prepared for the meal into elegant dishware that one already possesses, it will be possible with the advent of certain embodiments of holder 10 to simple snugly place the inelegant container that these salads come in into elegant holders 10 for placement on the table on which the meal is served.

One or more of the walls 15, for example one or more of the bottom wall 20 and the at least one sloping side wall (30, 40, 50, 60, 70) has a cut-out 80. Accordingly, the holder 10 comprises one or more cut-outs 80. In general, each of the one or more cut-outs 80 of holder 10 is surrounded by a solid portion of one of the walls. In other words, in certain embodiments, the cut-out 80 does not border on a free end of the side wall for example. The one or more cut-outs 80 may be shaped so as to allow a user to view contents of a particular container held by the holder 10, at least to the extent that the particular one of the containers is transparent (or translucent).

Figure 22:
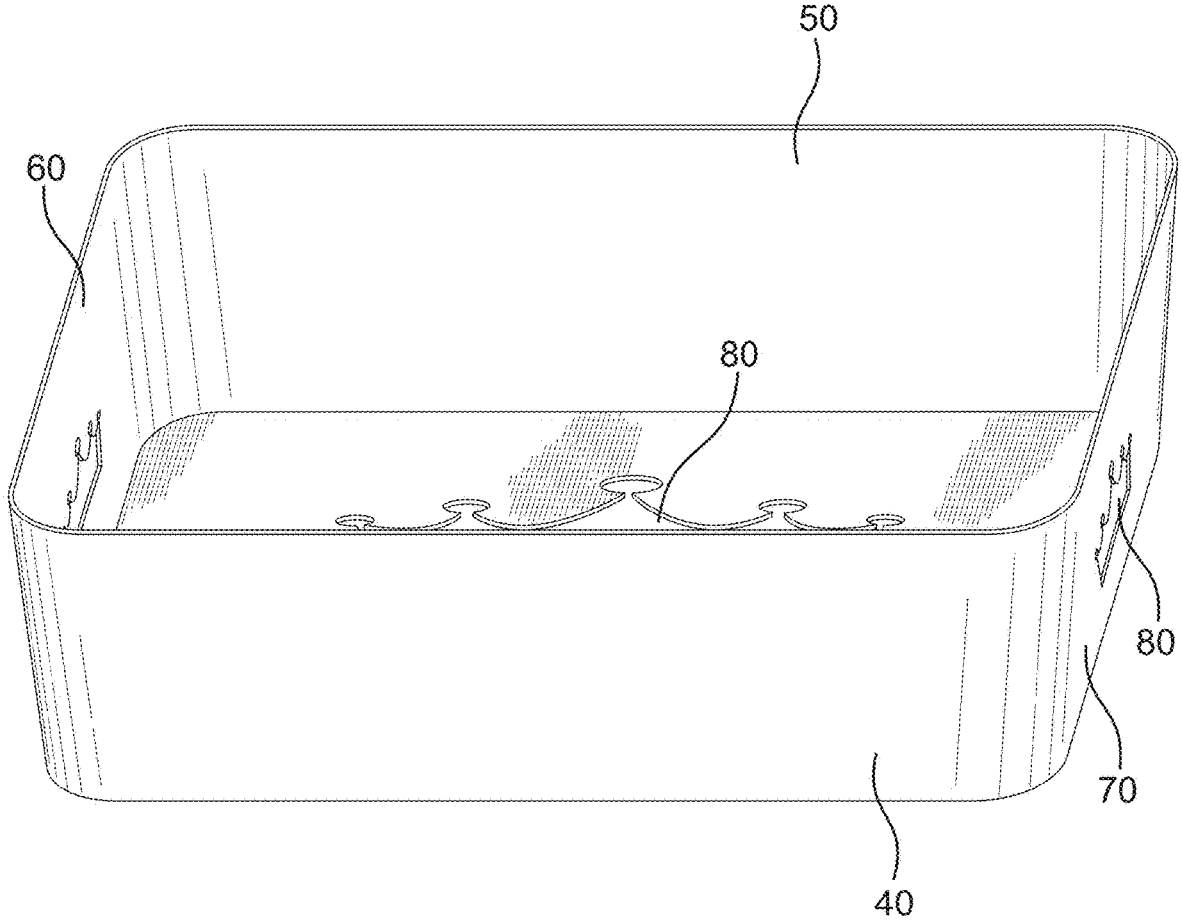
FIG. 22 is a view as in FIG. 1 except with smaller cut-outs, in accordance with one embodiment.
Figure 23:
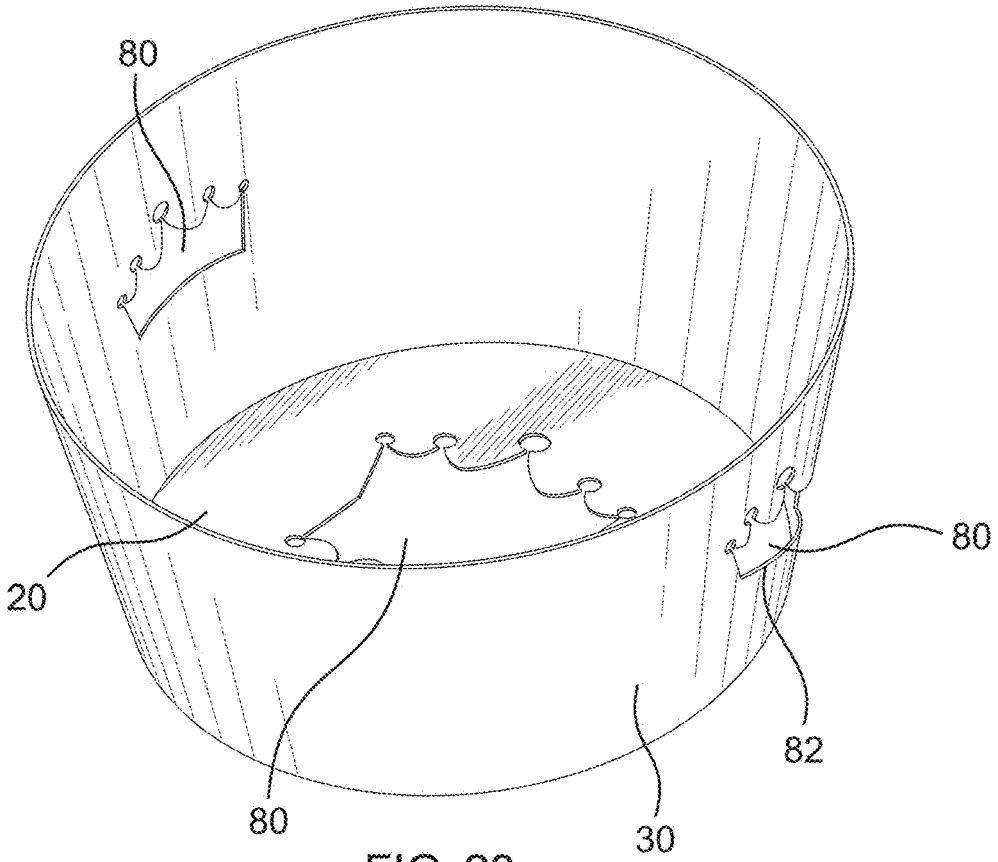
FIG. 23 is a view as in FIG. 8 except with smaller cut-outs, in accordance with one embodiment.

The size of the cut-outs 80 may vary and need not be exactly as shown in the drawings. For example, the cut-outs shown in FIG. 22 are smaller than those in FIG. 1. In some embodiments, each cut-out occupies a significant percentage of the surface area of the particular wall of the walls 15 that the particular cut-out is cut out of. Accordingly, the result is that the remaining portions of the walls 15 represent a frame.

Figure 16A:
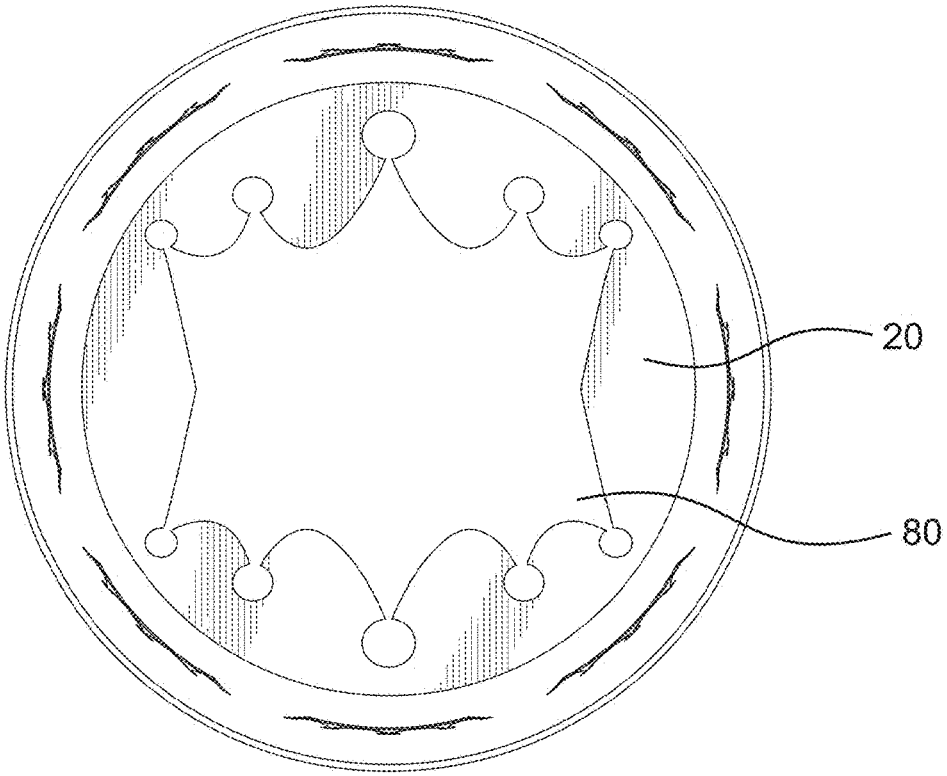
FIG. 16A is a top view of a substantially "round" holder depicting a double crown cut-out, in accordance with one embodiment.
Figure 16B:
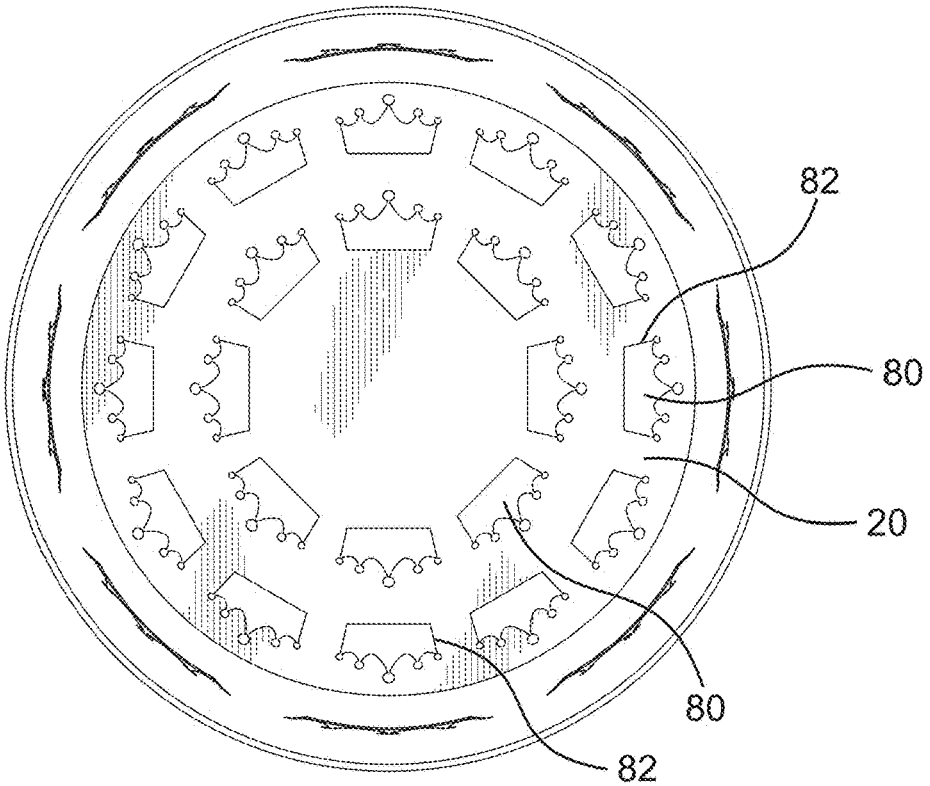
FIG. 16B is a top view of a substantially "round" holder depicting a series of smaller cut-outs, in accordance with one embodiment.
Figure 17:
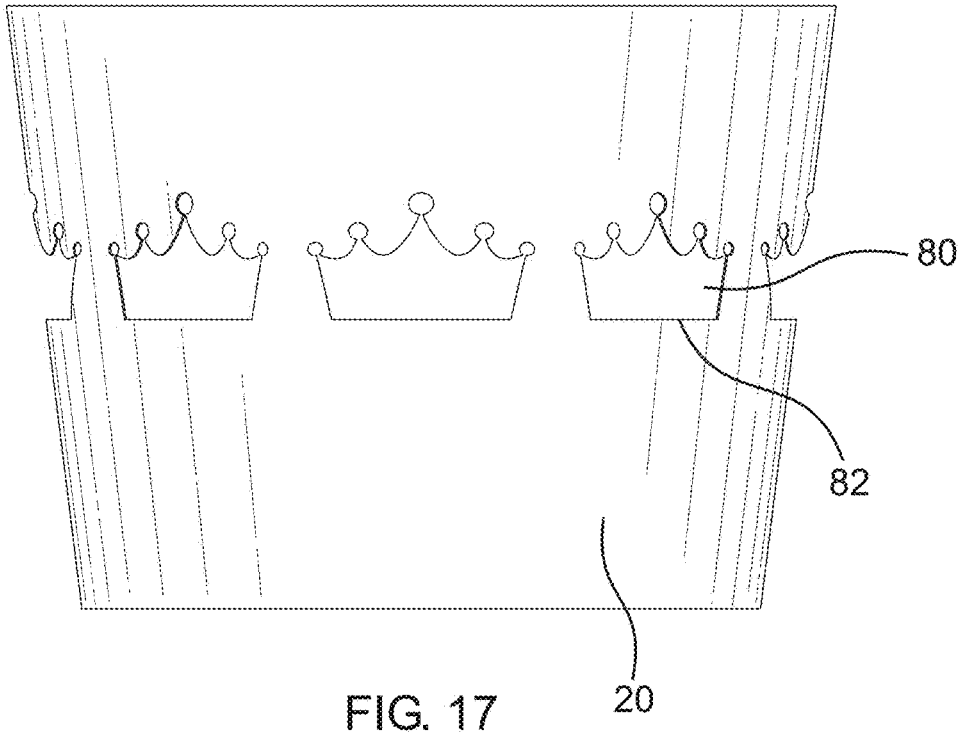
FIG. 17 is a side view of a substantially "round" holder depicting a series of smaller cut-outs, in accordance with one embodiment.
Figure 18:
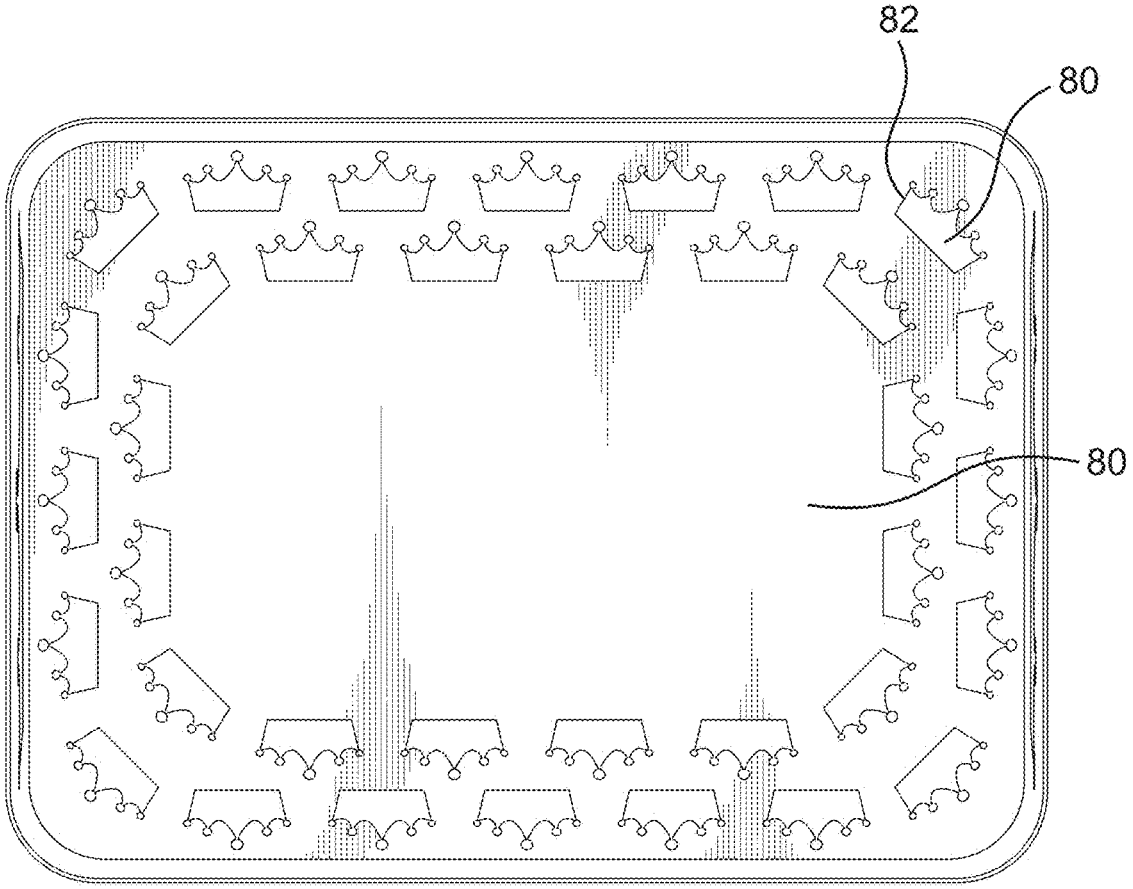
FIG. 18 is a top view of a substantially rectangular holder showing a series of smaller cut-outs, in accordance with one embodiment.
Figure 19:
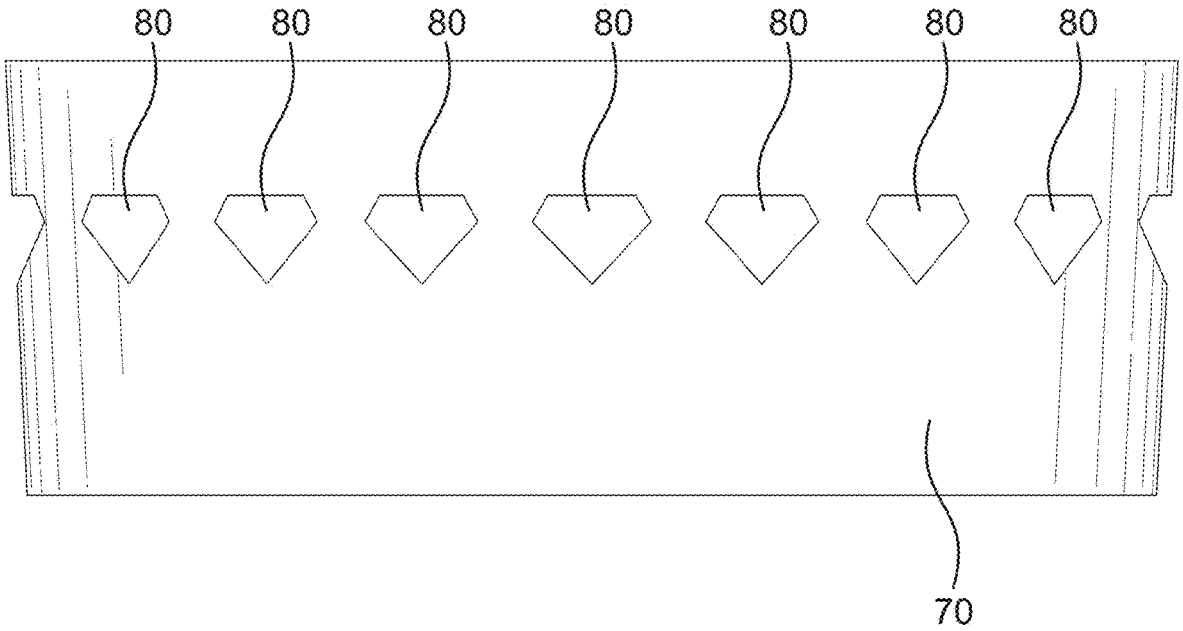
FIG. 19 is a rear view of a substantially rectangular holder depicting a series of diamond shaped cut-outs around a perimeter of a rear wall, in accordance with one embodiment.
Figure 20:
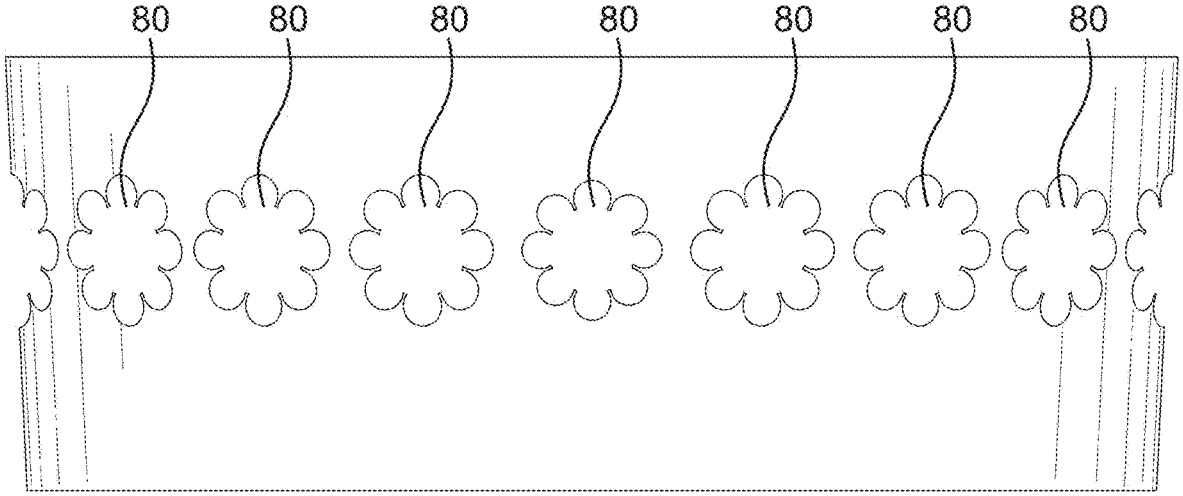
FIG. 20 is a rear view of a substantially rectangular holder depicting a series of flower-shaped cut-outs around a perimeter of a rear wall, in accordance with one embodiment.
Figure 21:
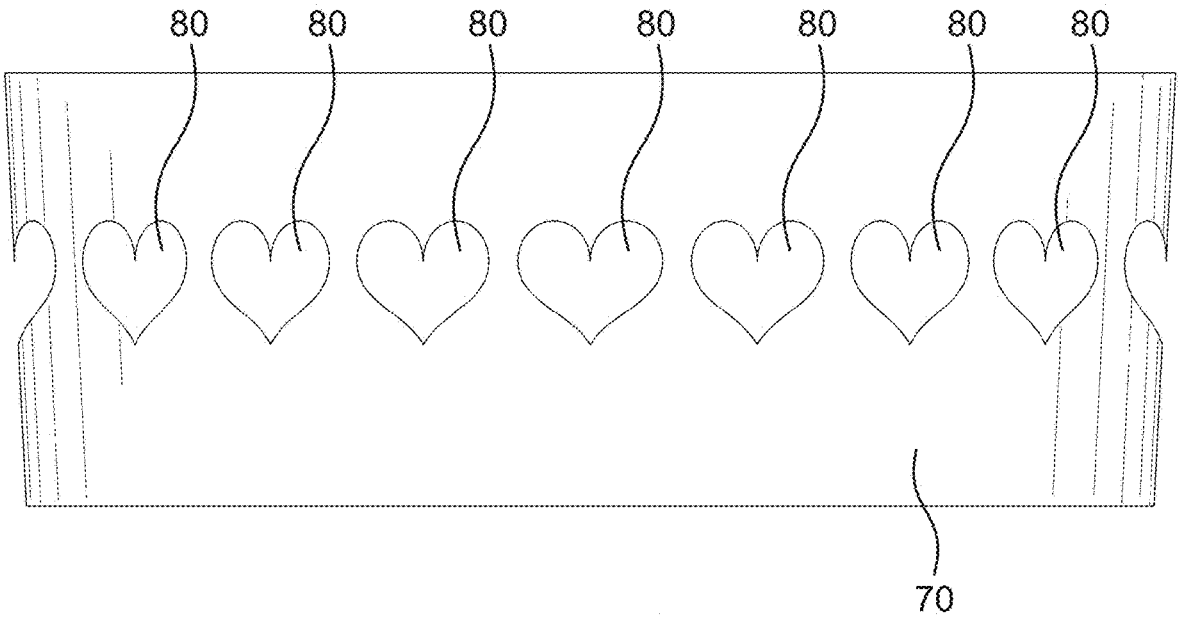
FIG. 21 is a rear view of a substantially rectangular holder depicting a series of heart-shaped cut-outs around a perimeter of a rear wall, in accordance with one embodiment.

In some embodiments, the cut-outs 80 are a series of many cut-outs that are situated either on the periphery of the bottom wall 20 (FIG. 18) or one of the sloping side walls, for example as shown in FIG. 17, FIG. 19, FIG. 20 and FIG. 21, or throughout the bottom wall 20 (FIG. 16B and FIG. 18). For example, in some embodiments, the cut-outs 80 comprises three or more particular cut-outs that are positioned on the periphery of the wall from which the particular cut-outs were cut out of.

In some embodiments, each cut-out 80 occupies at least 75% of a surface area of the particular wall that the cut-out is cut out of. This allows the user to see through the holder wall and through the transparent or translucent wall of the container in which the food is held in order to identify the food being held. In some embodiments, for example the cut-outs 80 in the bottom wall 20 of the bottom view of FIG. 7, each cut-out 80 occupies at least two-thirds of a surface area of the particular wall that the cut-out is cut out of. In some embodiments, each cut-out 80 occupies at least 60% of a surface area of the particular wall that the cut-out is cut out of. In some embodiments, each cut-out 80 occupies at least a majority of a surface area of the particular wall that the cut-out is cut out of. In some embodiments, each cut-out occupies at least 40% of a surface area of the particular wall that the cut-out is cut out of. In some embodiments, each cut-out 80 occupies at least a third of a surface area of the particular wall that the cut-out 80 is cut out of. In some embodiments, each cut-out 80 occupies at least a quarter (or 20% in other embodiments) of a surface area of the particular wall that the cut-out 80 is cut out of. In some embodiments, each cut-out occupies at least 15% of a surface area of the particular wall that the cut-out is cut out of. In some embodiments, each cut-out 80 occupies at least 10% or at least 5% or at least 3% of a surface area of the particular wall that the cut-out is cut out of.

In the case of a round wall 30 such as shown in FIGS. 8-14, for purposes of defining percentages that the cut-out 80 represents of the surface area of the wall from which the cut-out is taken out of, the approximately 180 degrees of the wall 30 that is visible to a user looking at the round holder 10 from the side is considered as the surface area of the wall 30.

Figure 13:
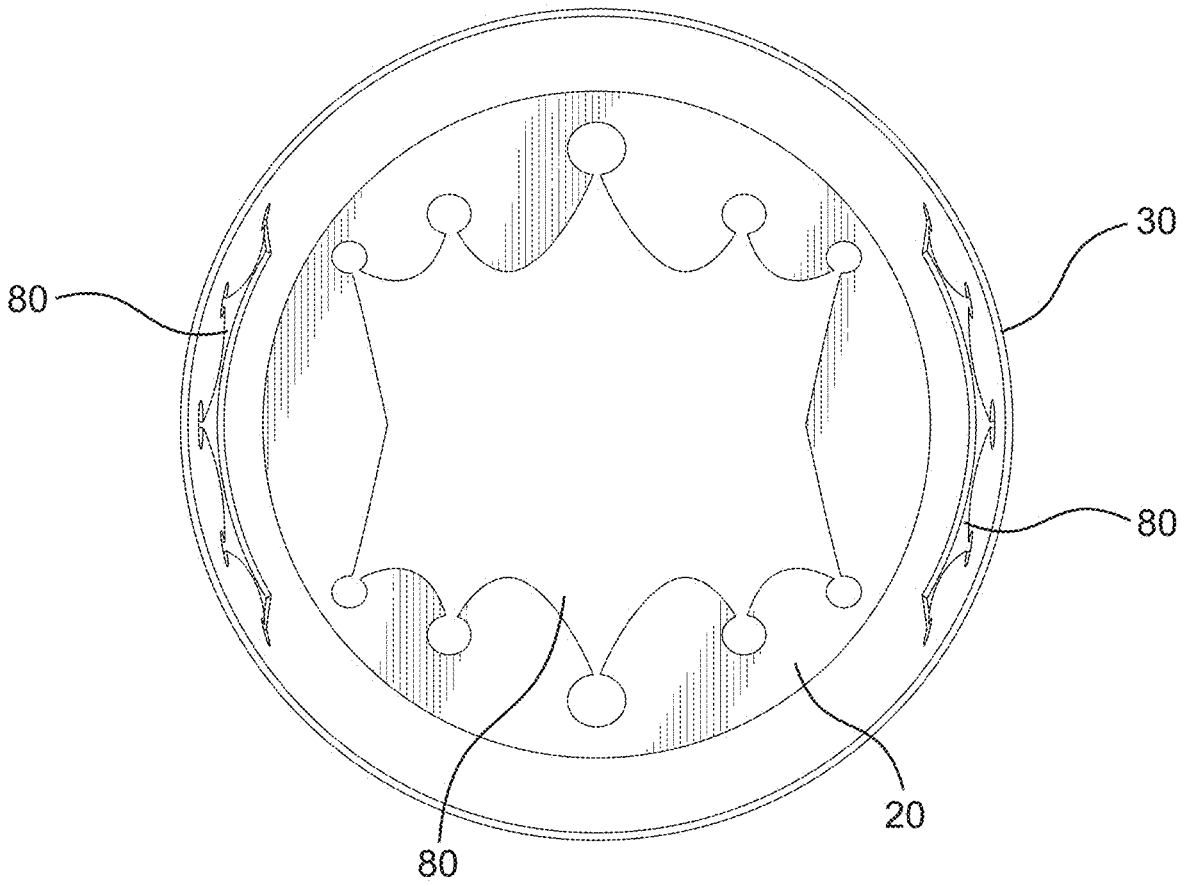
FIG. 13 is a top view of the holder of FIG. 8, in accordance with one embodiment.
Figure 14:
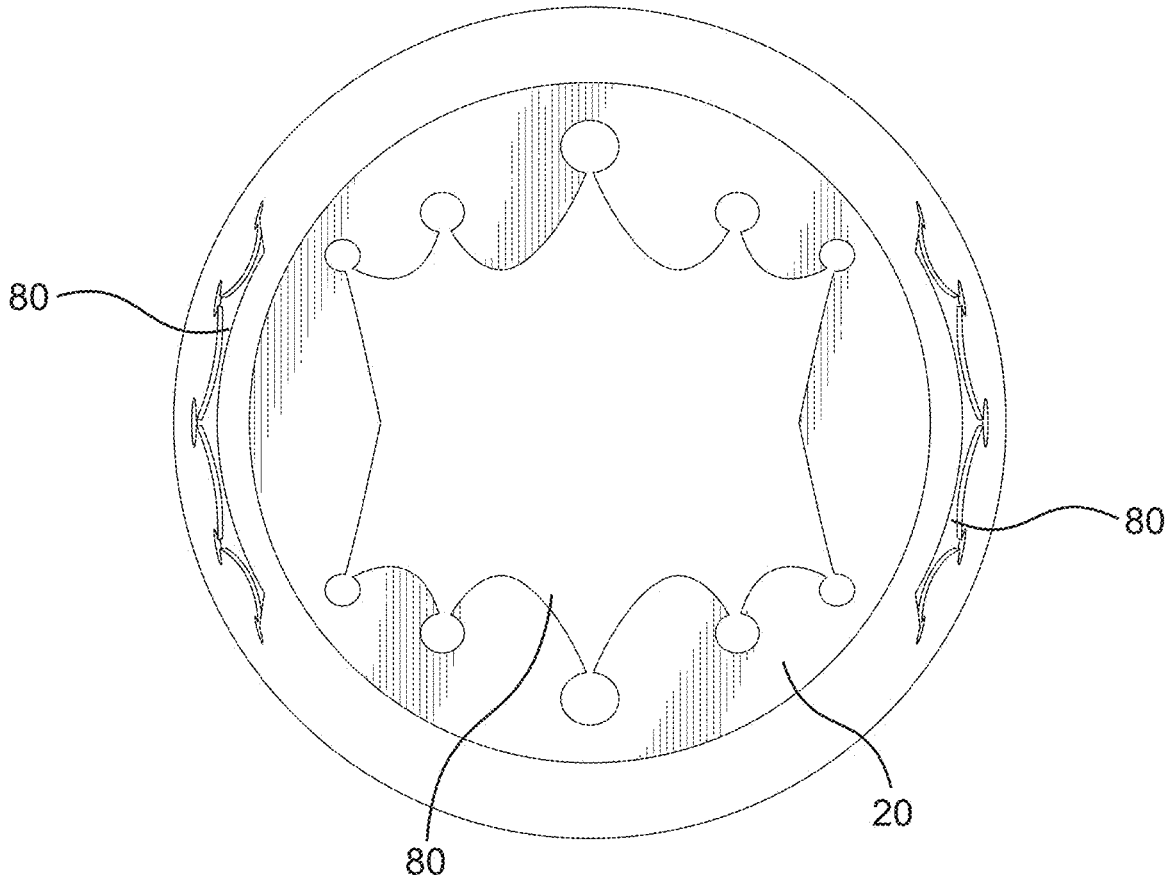
FIG. 14 is a bottom view of the holder of FIG. 8, in accordance with one embodiment.

In some embodiments, the size and/or shape of the cut-outs 80 is not unform throughout the walls 15 of holder 10. For example, as shown in FIG. 13 and FIG. 14, the bottom wall 20 has a cut-out that occupies a large share of the surface of the bottom wall 20 than the share of the visible side wall seen in FIG. 9.

In some embodiments, one or more of the cut-outs 80 include one or both of the following: (i) multiple identical cut-outs cut out of one of the walls, and (ii) an alphanumeric character, single or double crowns, a heart-shaped cut-out, a diamond-shaped cut-out, a celestial object, a human or animal figure, a flower, a dollar sign another decorative design. In some embodiments, the one or more cut-outs include at least three identical cut-outs in one of the walls. In some embodiments, the one or more cut-outs include at least six identical cut-outs in one of the walls.

As shown in FIGS. 1-3, 6-10 and 13-14, one or more of the walls 15 (whether bottom wall 20 or one or more of the side walls such as sloping side walls) has a cut-out 80. each particular cut-out 80 of the one or more cut-outs 80 occupies at least 40% of (or in other implementations at least a majority or in other implementations at least ⅔ or ¾ or ⅘ of, or in other implementations about 40% or about 50% or about 60% or about 75% or about 80% of a surface area of the particular wall that that particular cut-out is cut out of.

In this patent application the term "about" means plus or minus five percent of the quantity such that "about 50%" would denote a range from 47.5% to 52.5%.

Figure 6:
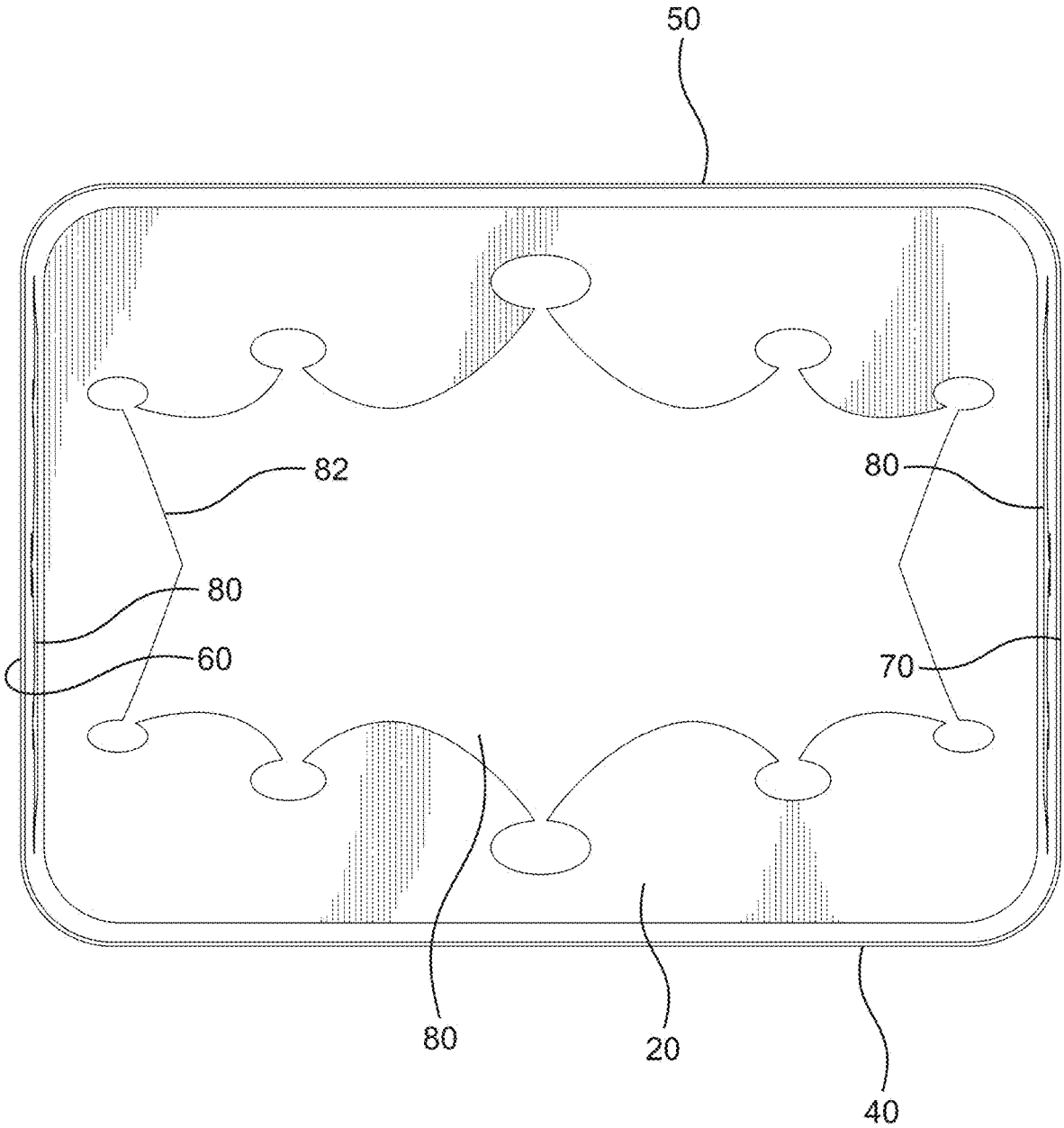
FIG. 6 is a top view of the holder of FIG. 1, in accordance with one embodiment.
Figure 7:
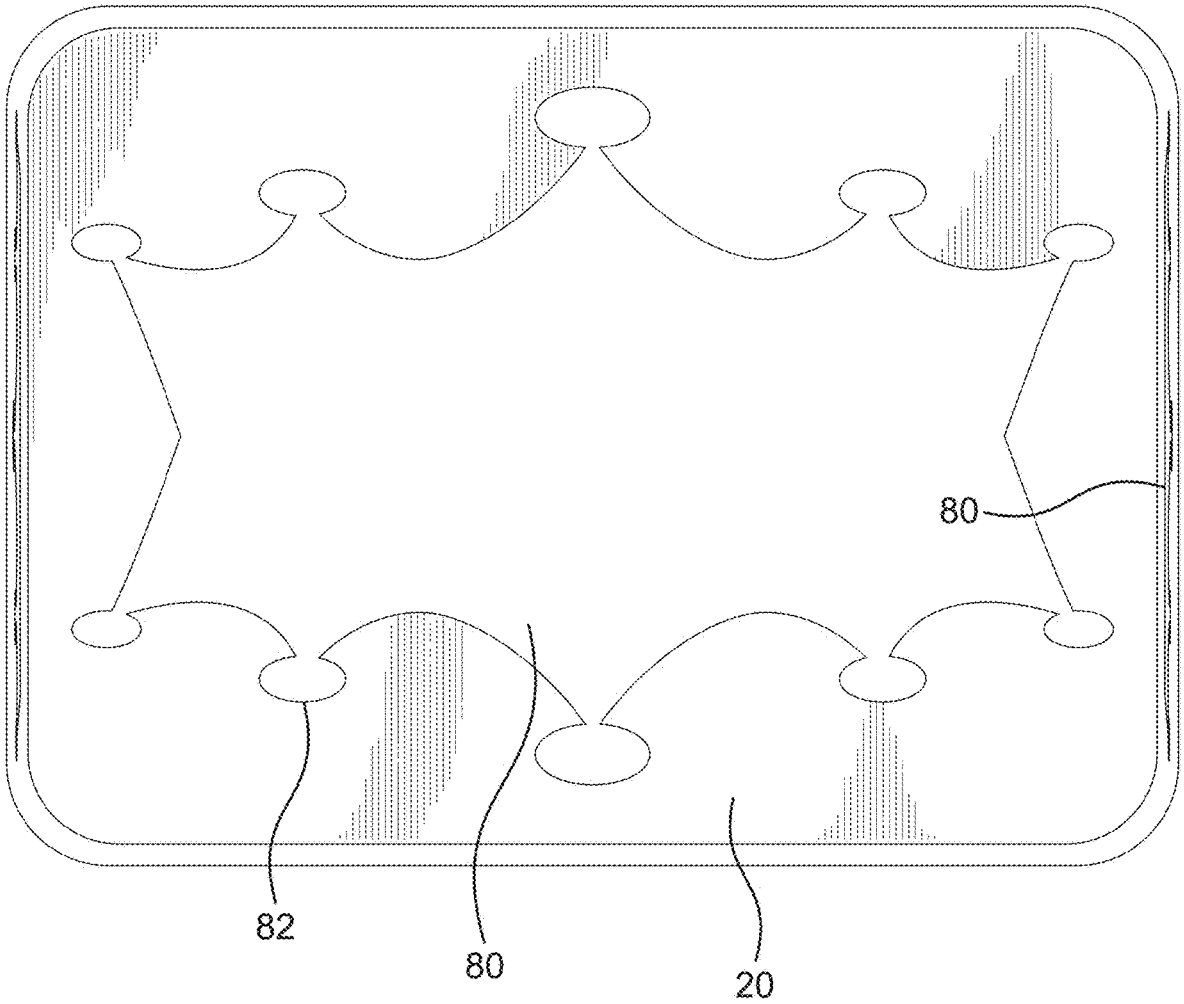
FIG. 7 is a bottom view of the holder of FIG. 1, in accordance with one embodiment.
Figure 8:
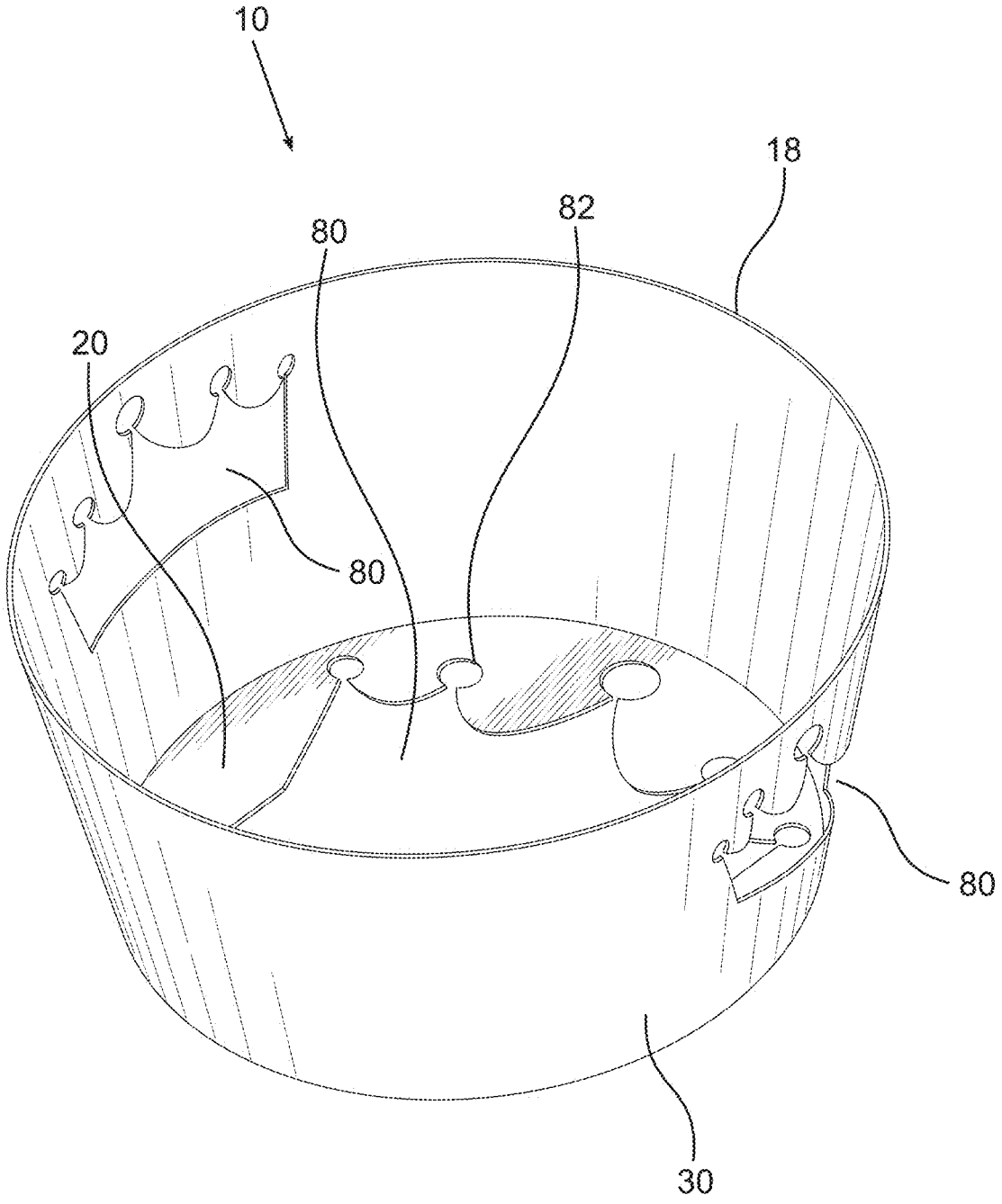
FIG. 8 is a perspective view of a substantially round holder for a food container, in accordance with one embodiment.
Figure 9:
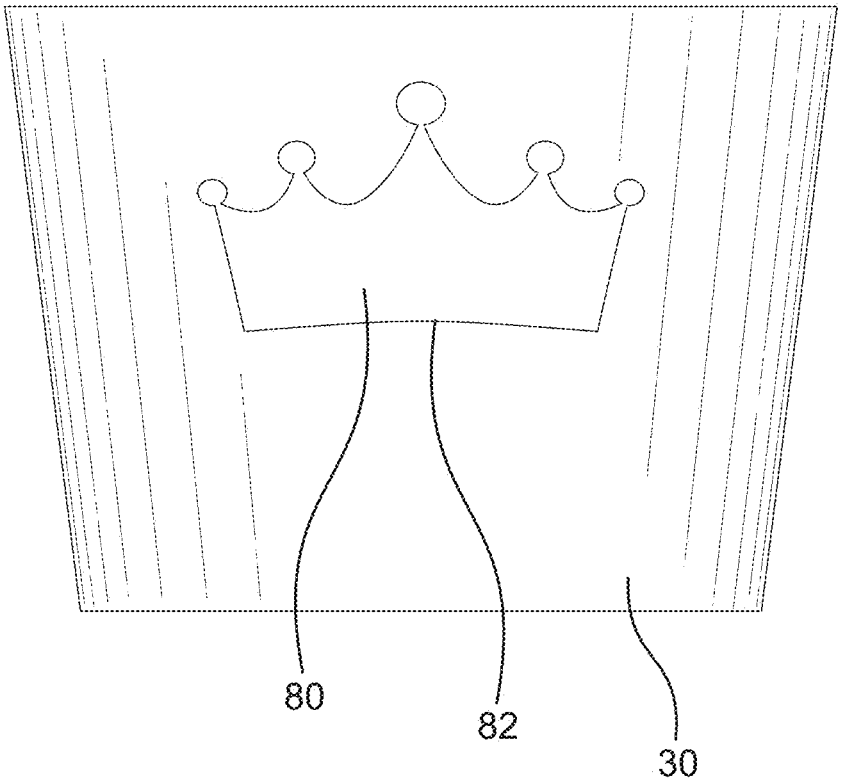
FIG. 9 is a front view of the holder of FIG. 8, in accordance with one embodiment.
Figure 10:
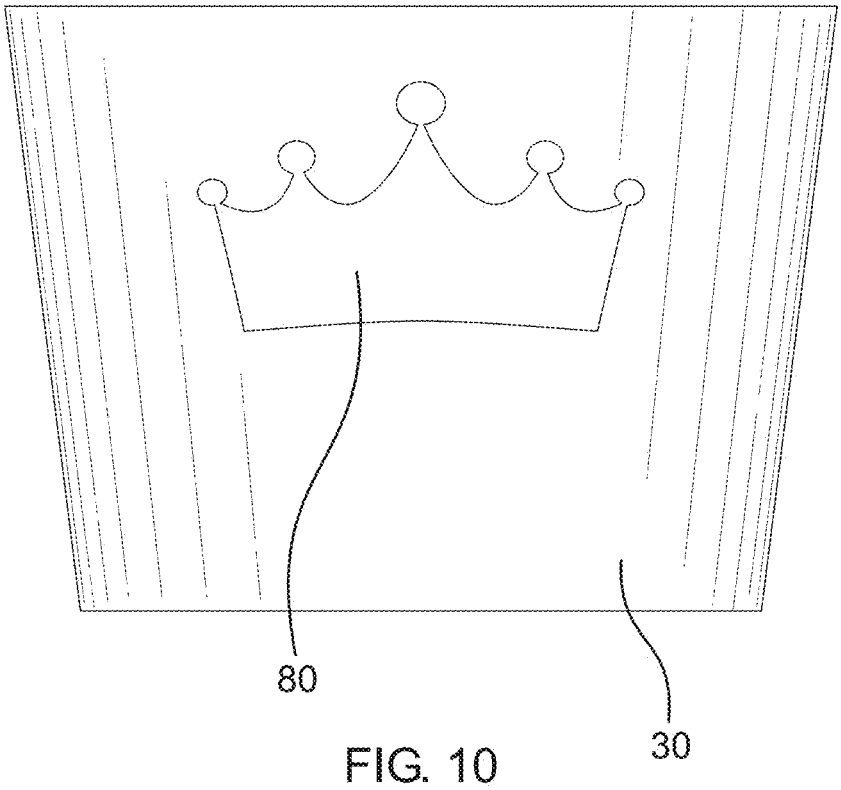
FIG. 10 is a rear view of the holder of FIG. 8, in accordance with one embodiment.
Figure 11:
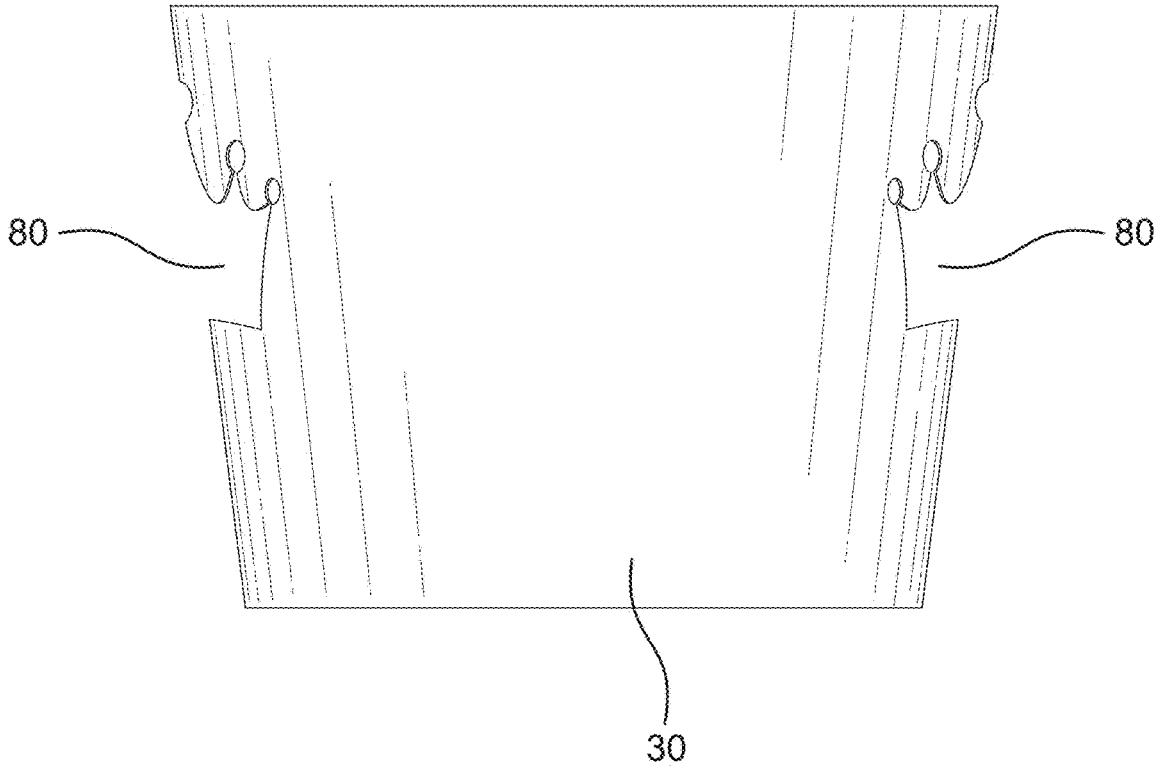
FIG. 11 is a left side view of the holder of FIG. 8, in accordance with one embodiment.
Figure 12:
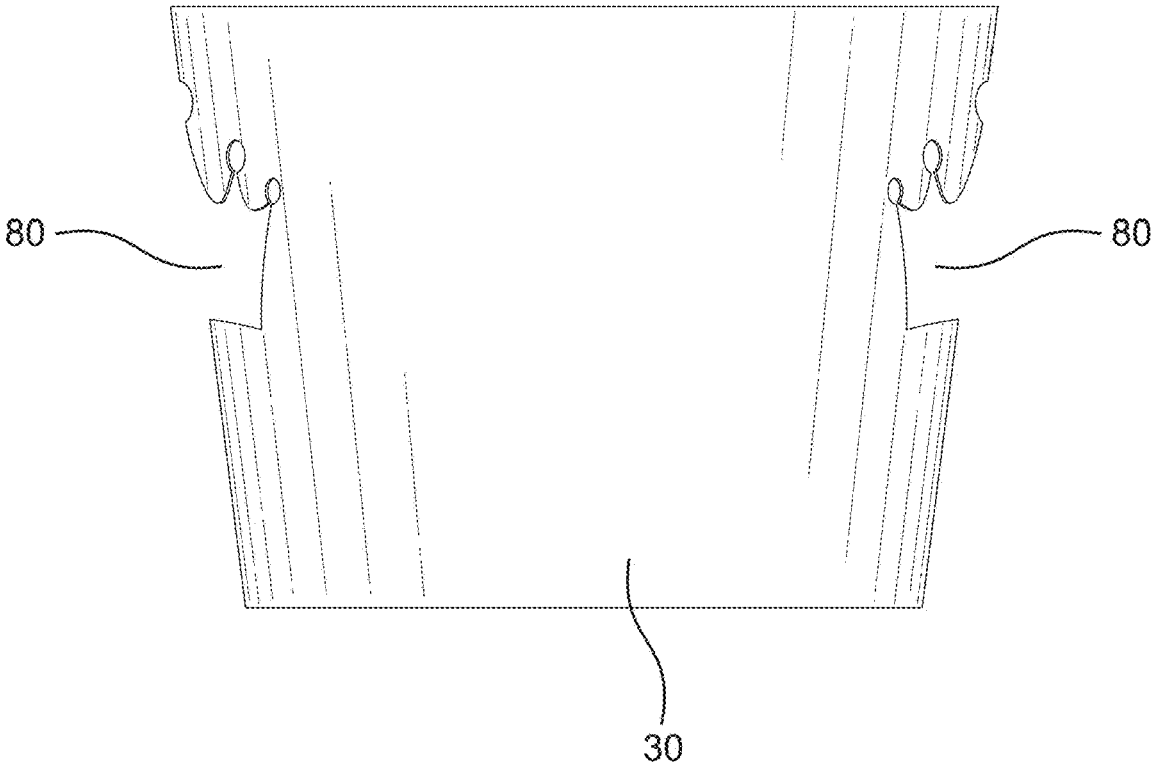
FIG. 12 is a right side view of the holder of FIG. 8, in accordance with one embodiment.

For example, as shown in FIG. 6 (top view of holder 10 showing bottom cut-out) and in FIG. 7 (bottom view of holder 10 showing bottom cut-out), the cut-out in the bottom wall 20 may occupy at least 40%, or in other implementations, at least a majority or at least 60% or at least ⅔ or at least ¾ or at least ⅘, of the surface area of the bottom wall 20 from which it is cut out.

In some embodiments, each of the one or more cut-outs 80 in the holder, not just in the bottom wall 20 but also in the sloping side wall(s) (30, 40, 50, 60, 70) occupy 40%, or a majority, or 60% or ⅔, or ¾ or ⅘, of the surface area of the particular wall from which it is cut out.

In some embodiments, there is a cut-out in the bottom wall 20 and in one or both of the front wall 60 and rear wall 70. In other embodiments (whether round, square, rectangular or otherwise), there is a cut-out in the bottom wall 20 and one or both of the side walls (30, 40, 50, 60, 70). In still other embodiments (whether round, square, rectangular or otherwise), there is a cut-out in the bottom wall 20 and in all (or all except one) of the side walls (30, 40, 50, 60, 70). In some embodiments, there is no cut-out in the bottom wall and one or more cut-outs in the side wall or walls.

In the case of cut-outs in the sloping walls (left and right side walls 40, 50 or front wall 60 or rear wall 70 or round side wall 30), in some embodiments, the cut-out 80 is positioned higher than the middle of the height of the wall from which it is cut out—that is, closer to the rim 18 (FIG. 1) or top of the holder 10 than to the bottom wall 20 of the holder 10.

In some implementations, there is no more than one cut-out in any particular wall of the holder 10.

In general, the one or more cut-outs may be shaped so as:

(a) to define a source identifier associated with the holder (meaning that the shape of the cut-out is itself in the shape of the source identifier (such as a logo or name or symbol or word etc.) and (b) to allow a user to view contents of one of the food containers held by the holder.

As shown in FIG. 6, FIG. 7, FIG. 13 and FIG. 14, in some implementations, the cut-out in a particular wall of holder 10 is in some embodiments shaped as a double crown (when the cut-out appears in the bottom wall 20) and as a single crown when the cut-out appears in one of the sloping side walls.

In some embodiments, as shown in FIGS. 1-3, 6-7, 8-10 and 13-14, each of the cut-outs that defines the source identifier (and allows viewing the contents of the food container) is a single continuous cut-out in that one can trace the border 82 (FIG. 6) of the cut-out 80 with a marking implement (for example a pencil) with a single continuous motion without having to lift the marking implement and resume tracing the border.

In some implementations, for entertainment of children, the bottom cut-out 80 may be used as a stencil.

In some embodiments, the rest of the wall (any such wall that has a cut-out) is a continuous solid piece.

In some embodiments, the holder 10 is configured to be lifted by grasping the sloping wall or walls of the holder 10. So, for example, in some embodiments, the holder 10 does not have a handle.

One advantage of the cut-outs is the drainage of water from the holder 10 after they have been rinsed during cleaning of the holder 10.

An additional function of the cut-outs is that in some implementations the bottom cut-out 80 for example can be used to render the remainder of the bottom wall 20 as a frame such as if a decorative sheet containing a decorative design is placed at the bottom of the holder 10 with the decorative side facing the cut-out. Then the holder can be placed on its side (right side or left side) and the decorative design functions as a picture wherein the cut-out in the bottom wall 20 allows the remainder of the bottom wall 20 to be the picture frame for the decorative design.

The cut-outs 80 appearing in the walls of holder 10 may comprise shapes other than those shown in the drawings.

Figure 24:
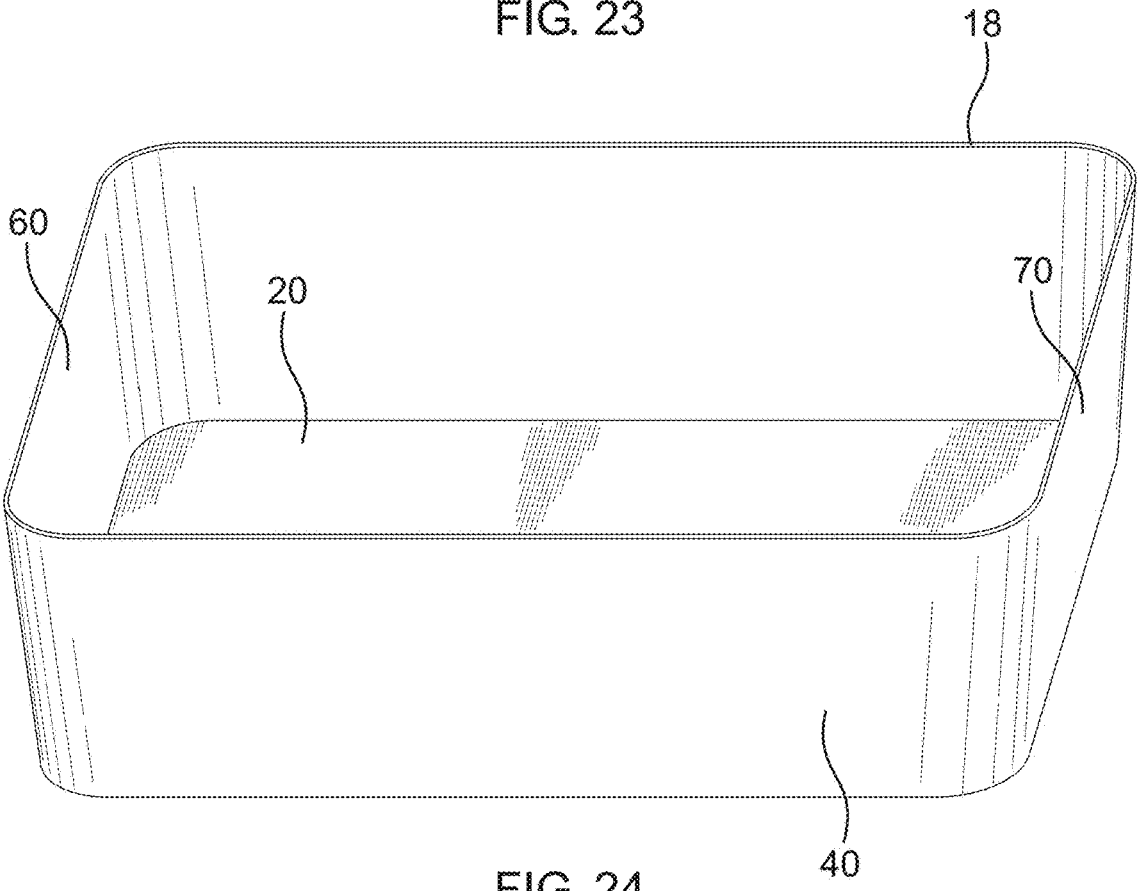
FIG. 24 is a view as in FIG. 1 except without cut-outs, in accordance with one embodiment.
Figure 25:
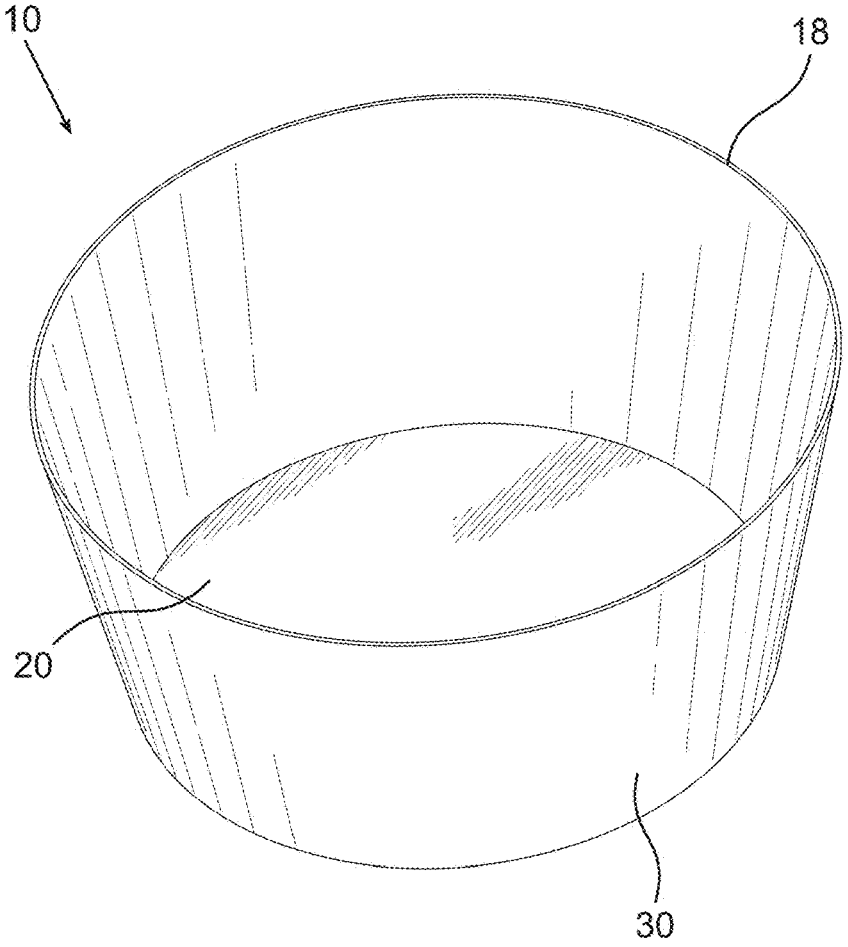
FIG. 25 is a view as in FIG. 8 except without cut-outs, in accordance with one embodiment.
Figure 26:
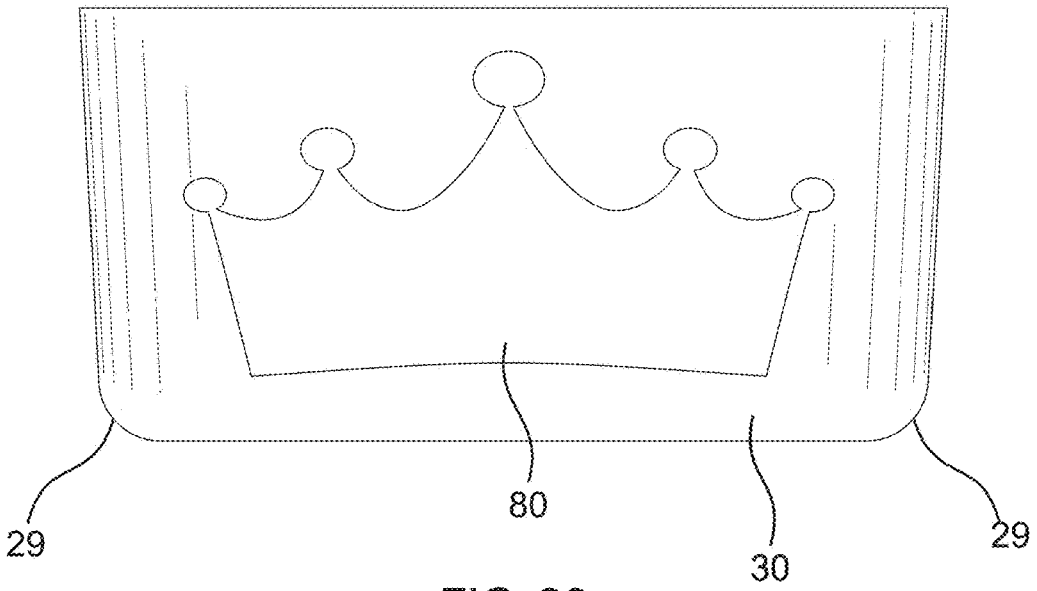
FIG. 26 is a front view of a substantially rectangular holder showing rounded bottom corners, in accordance with one embodiment.

In certain other embodiments, as shown in FIG. 24 and FIG. 25, holder 10 does not have a cut-out 80.

Figure 27A:
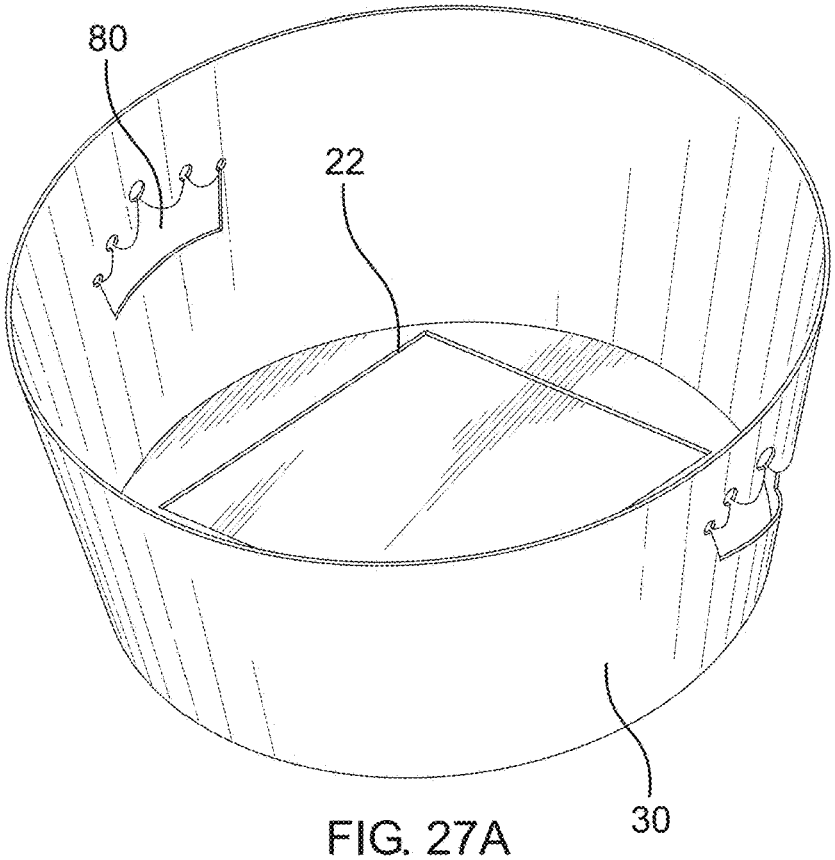
FIG. 27*a* depicts a perspective view of a substantially round holder with a sliced bottom to render the bottom stable, in accordance with one embodiment.
Figure 27B:
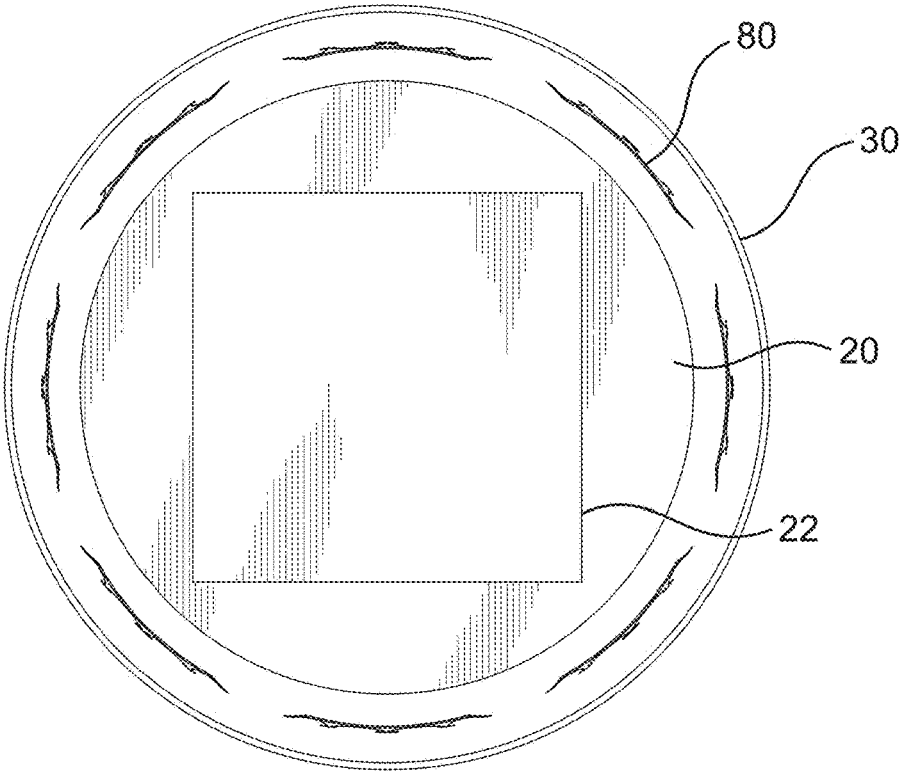
FIG. 27*b* depicts a top view of the substantially round holder of FIG. 27*a*, in accordance with one embodiment.
Figure 27C:
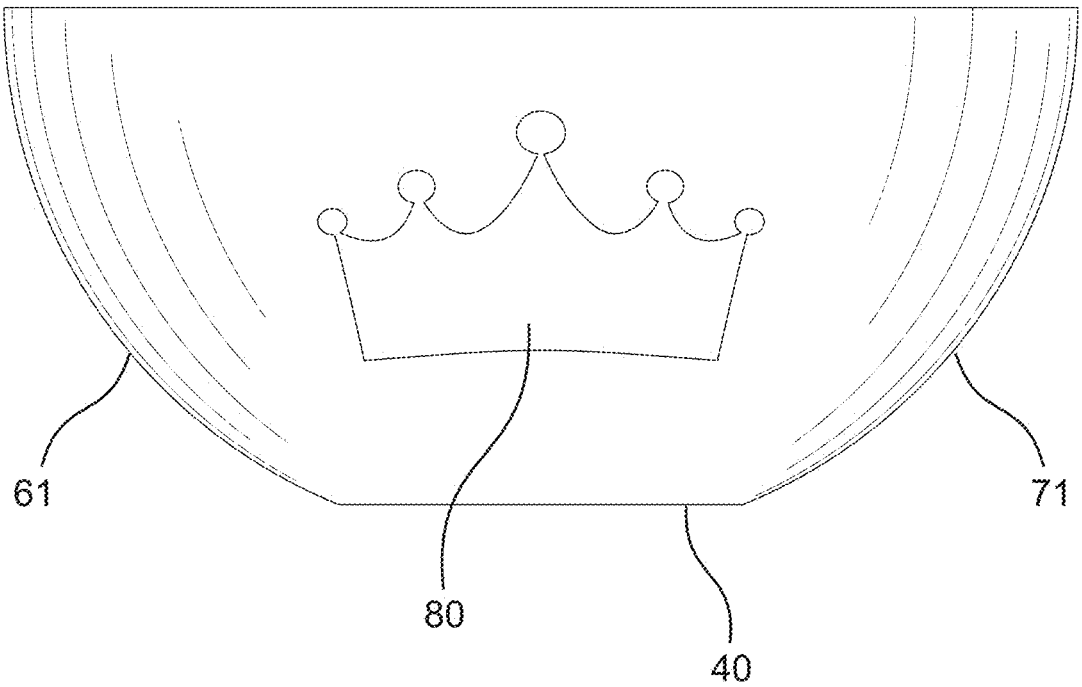
FIG. 27C depicts a side view of a substantially bowl-shaped holder, in accordance with one embodiment.
Figure 28A:
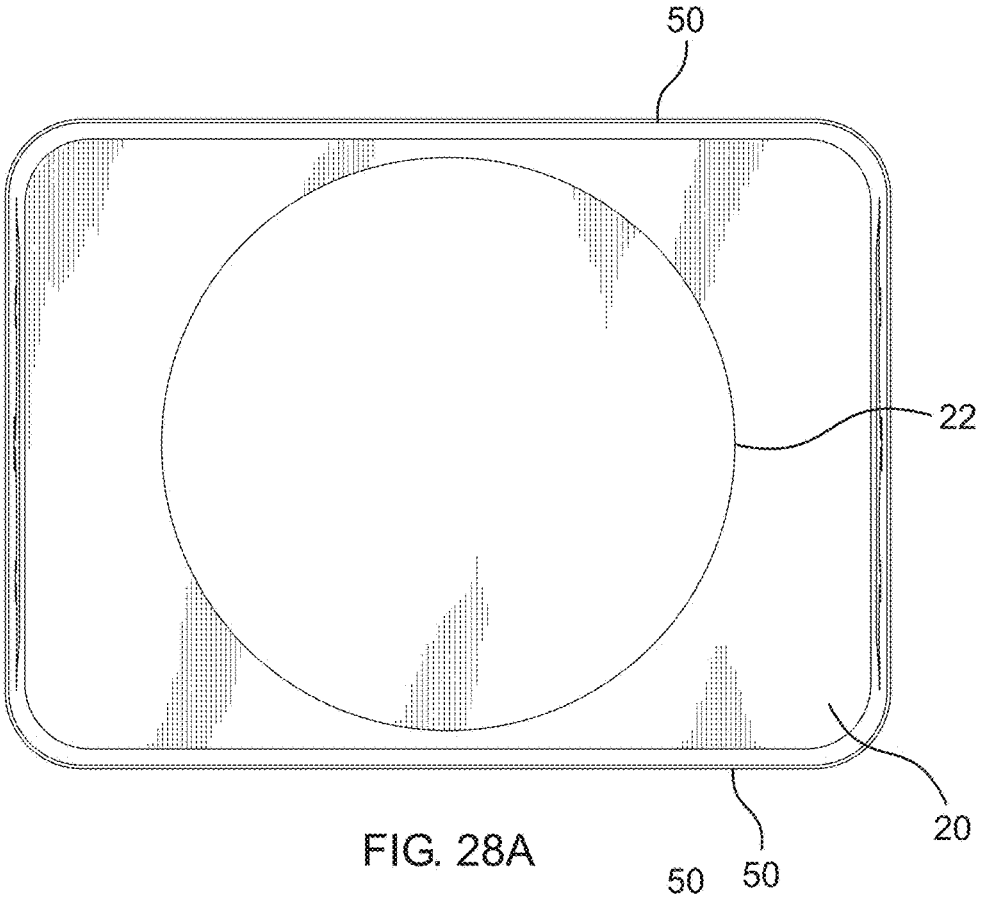
FIG. 28*a* is a top view of a substantially rectangular holder having a substantially round bottom indentation, in accordance with one embodiment.
Figure 28B:
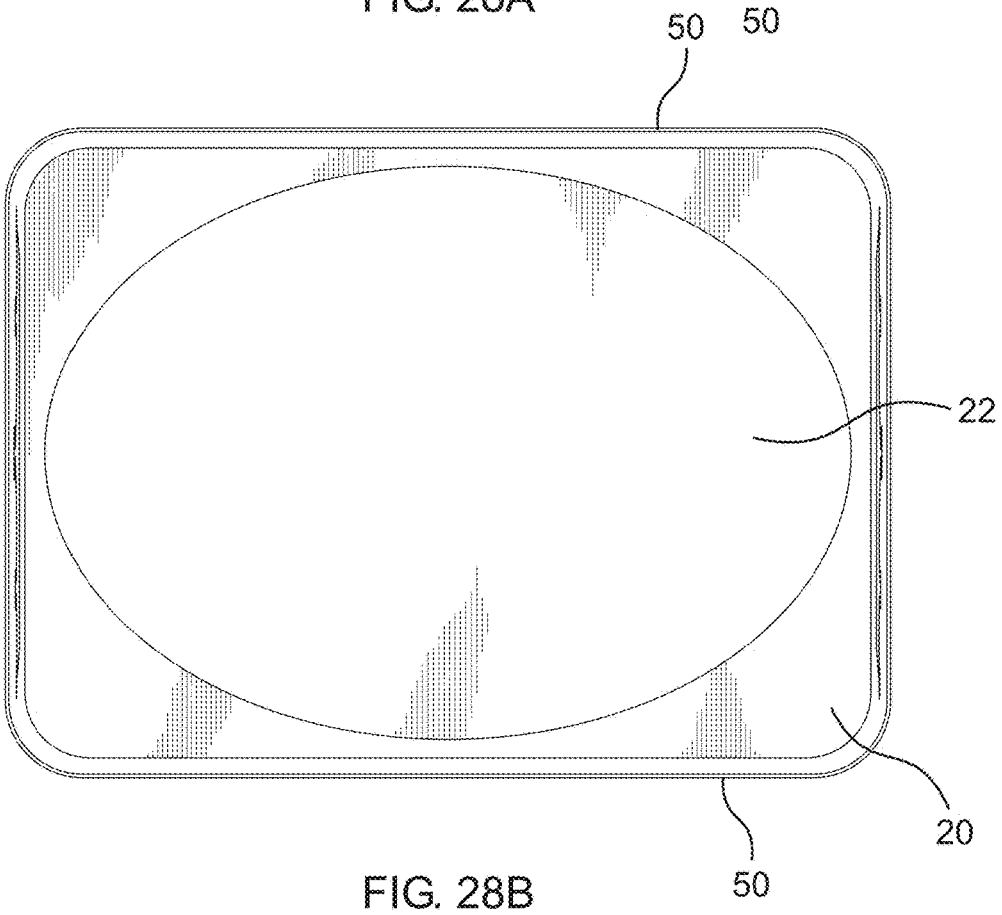
FIG. 28*b* is a top view of a substantially rectangular holder having a substantially oval bottom indentation, in accordance with one embodiment.
Figure 28C:
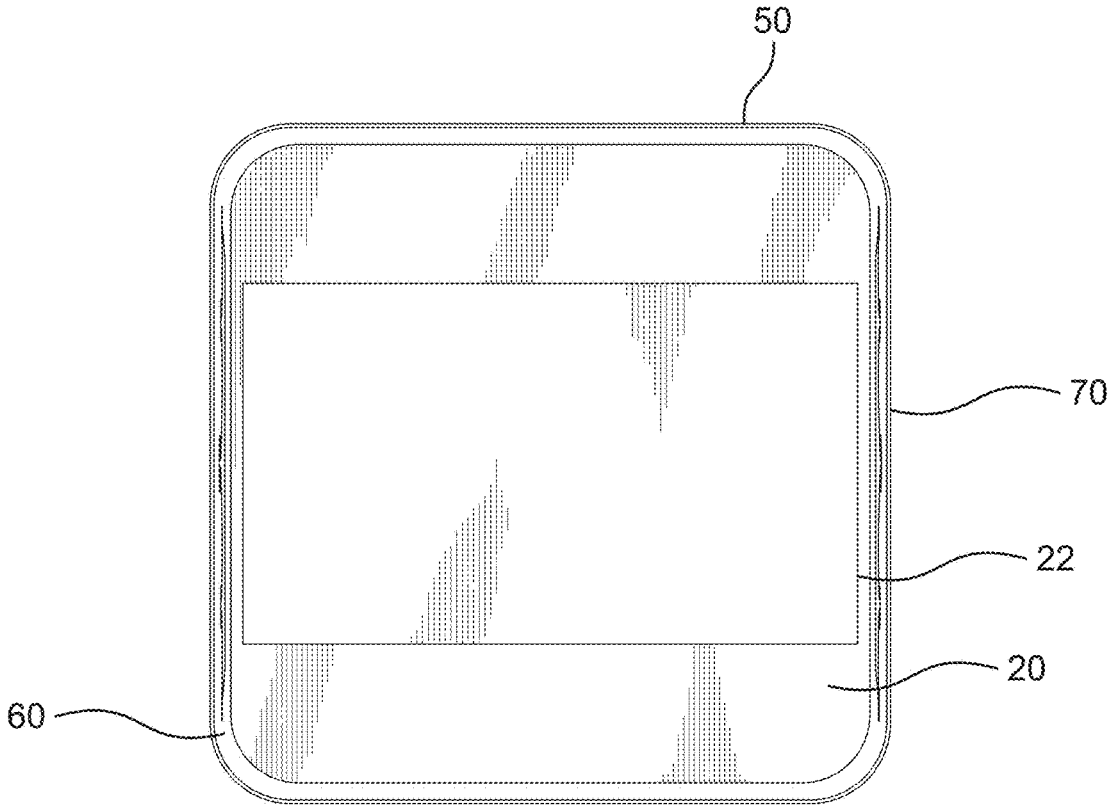
FIG. 28*c* is a top view of a substantially square holder having a substantially rectangular bottom indentation, in accordance with one embodiment.
Figure 28D:
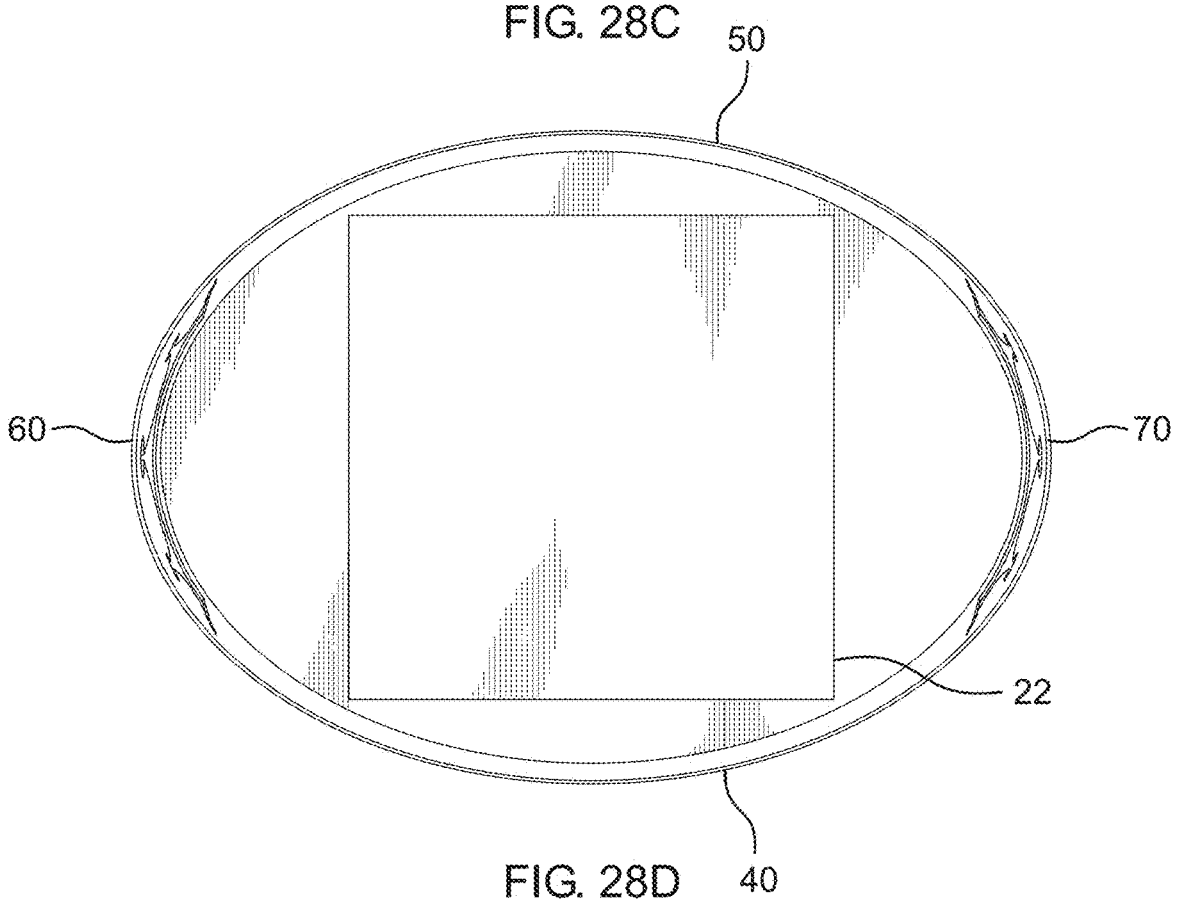
FIG. 28*d* is a top view of a substantially oval holder having a substantially square bottom indentation, in accordance with one embodiment.

In some embodiments, as shown in FIG. 27*a*, FIG. 27*b*, FIG. 28*a* and FIG. 28*b*, the bottom wall 20 of holder 10 has an indentation 22 configured to snugly receive a bottom of a container. This is applicable to a holder 10 of any shape, and that-shaped holder 10 may have an indentation 22 in the bottom wall 20 where the indentation is of a different shape than the shape of the holder 10. For example, as shown in FIG. 27*a* and FIG. 27*b*, the holder 10 side walls are rounded and the indentation 22 is substantially rectangular. In FIG. 27C the side walls 30 are rounded like a bowl. In another example, as shown in FIG. 28*a*, the holder 10 is substantially rectangular and the indentation 22 on the bottom wall is substantially round. In FIG. 28*b*, the holder 10 is substantially rectangular and the indentation 22 on the bottom wall is substantially oval. FIG. 28*c* depicts a substantially square holder 10 with a substantially rectangular indentation 22 on the bottom wall 20. FIG. 28*d* depicts a substantially oval holder 10 having a substantially square indentation 22.

Other such examples are also possible such as: the holder 10 is substantially rectangular and the indentation is round and configured to snugly receive the bottom of a round container, or wherein the holder 10 is substantially rectangular and the indentation 22 is substantially oval and configured to snugly receive the bottom of a substantially oval container, or wherein the holder is substantially rectangular and the indentation 22 is substantially square and configured to snugly receive the bottom of a substantially square container, or wherein the holder 10 is substantially round and the indentation 22 is substantially rectangular and configured to snugly receive the bottom of a substantially rectangular container, or wherein the holder 10 is substantially round and the indentation 22 is substantially oval and configured to snugly receive the bottom of a substantially oval container, or wherein the holder 10 is substantially round and the indentation 22 is substantially square and configured to snugly receive the bottom of a substantially square container, or wherein the holder 10 is substantially oval and the indentation 22 is substantially rectangular and configured to snugly receive the bottom of a substantially rectangular container, or the holder 10 is substantially oval and the indentation 22 is substantially round and configured to snugly receive the bottom of a substantially round container, or wherein the holder 10 is substantially oval and the indentation 22 is substantially square and configured to snugly receive the bottom of a substantially square container, or wherein the holder 10 is substantially square and the indentation 22 is rectangular and configured to snugly receive the bottom of a substantially rectangular container, or wherein the holder 10 is substantially square and the indentation 22 is substantially round and configured to snugly receive the bottom of a substantially round container or wherein the holder 10 is substantially square and the indentation 22 is oval and configured to snugly receive the bottom of a substantially oval container. Other shapes and combinations are also possible.

FIG. 31*a* is a perspective view of a substantially square holder 10 holding a package of crackers 90 seen through a transparent cellophane package 92, in accordance with one embodiment. The cut-out 80 is shaped as letters that denote a source identifier for the company OSEM®. The transparent wall 92 may be the entire wall, or it may be a transparent window within a wall of holder 10, as shown in FIG. 31*c*. Accordingly, in any embodiment of holder 10 described herein, a transparent window 88 may be present in a wall of holder 10 instead of or in addition to one or more cut-outs 80 or portions of cut-outs 80, as shown in FIG. 31*c*, FIG. 31*d*, FIG. 31*e*, FIG. 31*f* and FIG. 31*g*, where the transparent window 88 is in the side wall. In FIG. 31*d*, the holder also includes a lid 75. A side wall may also include both a transparent window 88 and a cut-out 80. Furthermore, one or more of the transparent windows 88 in any embodiment of holder 10 may be shaped to define a source identifier, as for example shown in FIG. 31D, FIG. 31F and FIG. 31G.

Figure 31B:
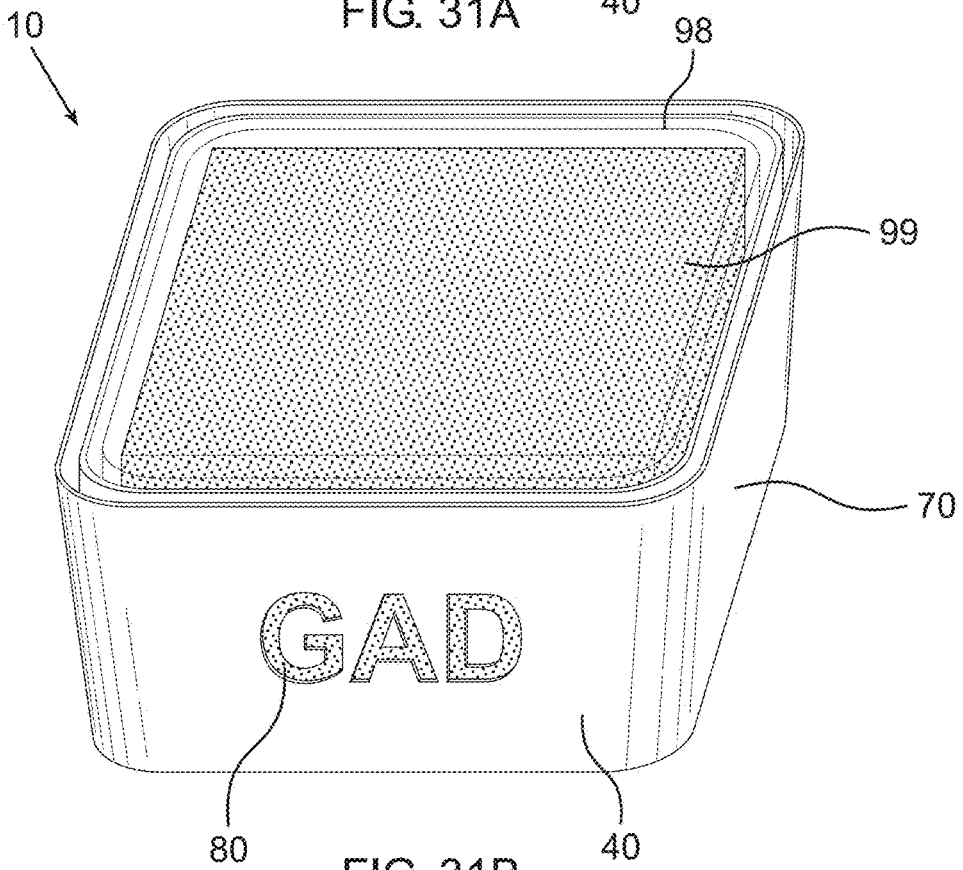
FIG. 31B is a perspective view from the topo and side of a substantially square holder holding a package of cheese, in accordance with one embodiment.
Figure 31C:
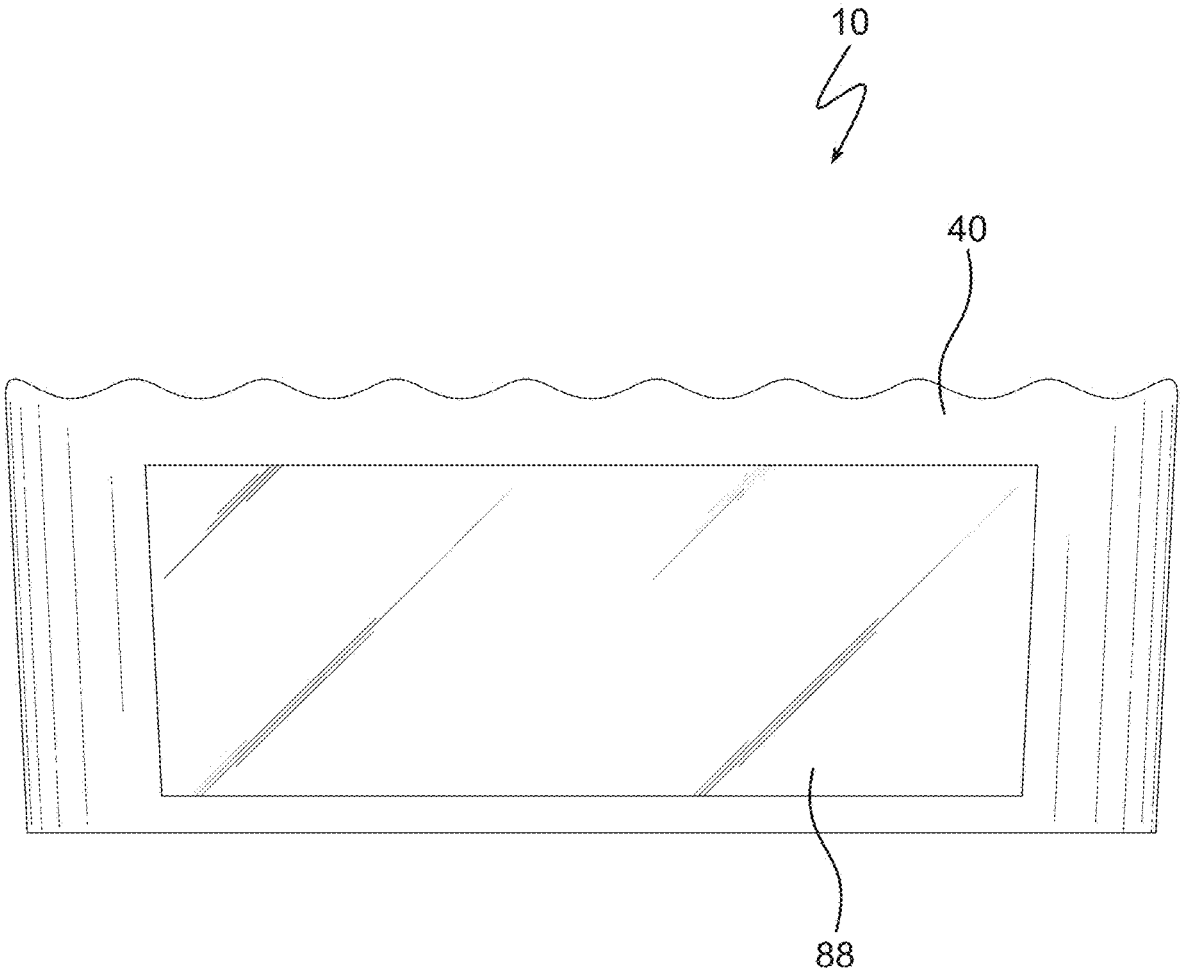
FIG. 31C is a perspective view showing a rectangular holder with a transparent side wall, in accordance with one embodiment.
Figure 31D:
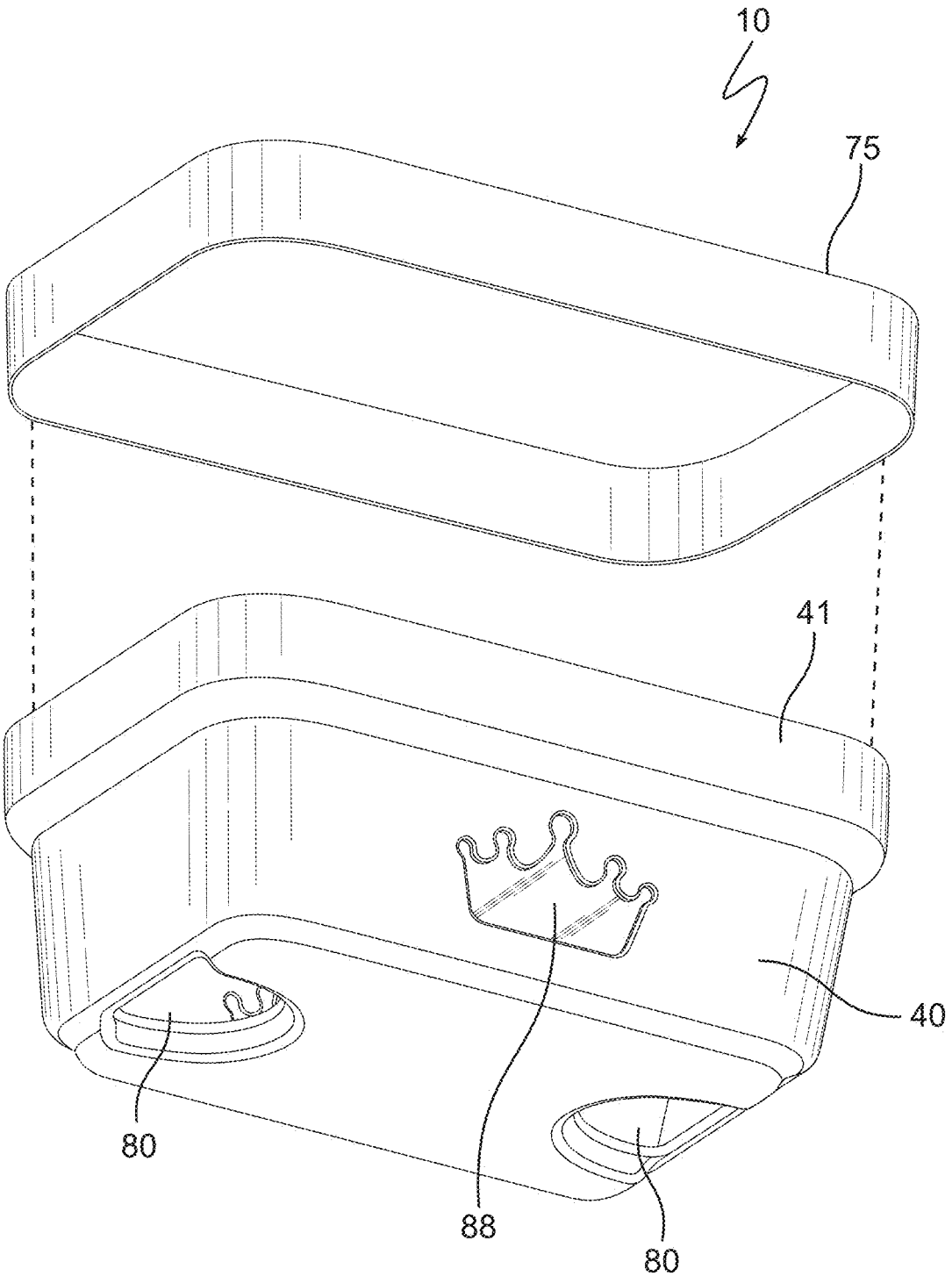
FIG. 31D is a side view of a rectangular container showing a transparent window and including a lid, in accordance with one embodiment.
Figure 31E:
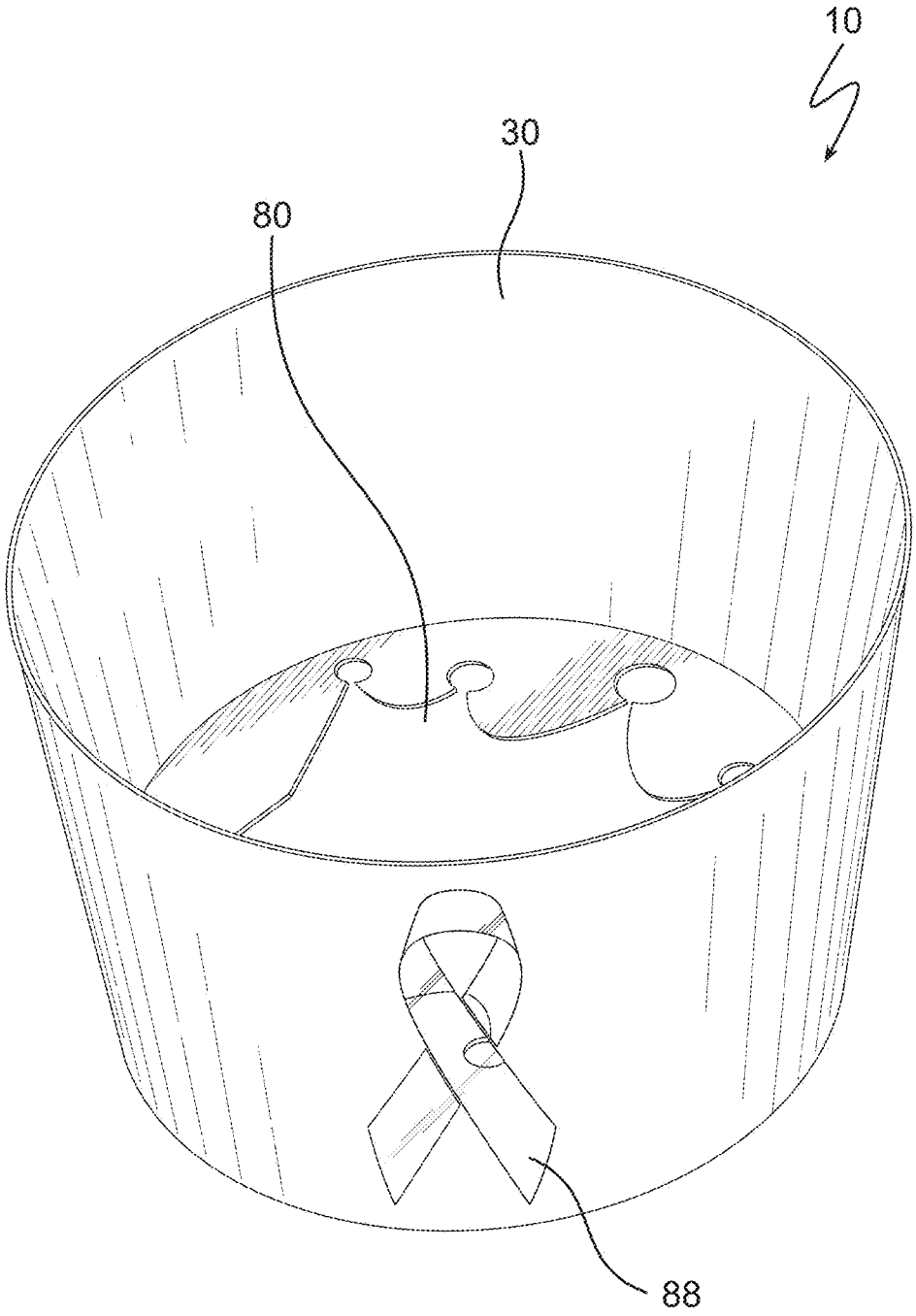
FIG. 31E is a perspective view of a decoration element having a transparent window, in accordance with one embodiment.

FIG. 31*b* is a perspective view of a substantially square holder holding a package 98 of cheese 99, in accordance with one embodiment. The cut-out 80 is shaped as letters that denote a source identifier for the company GAD®.

Figure 32:
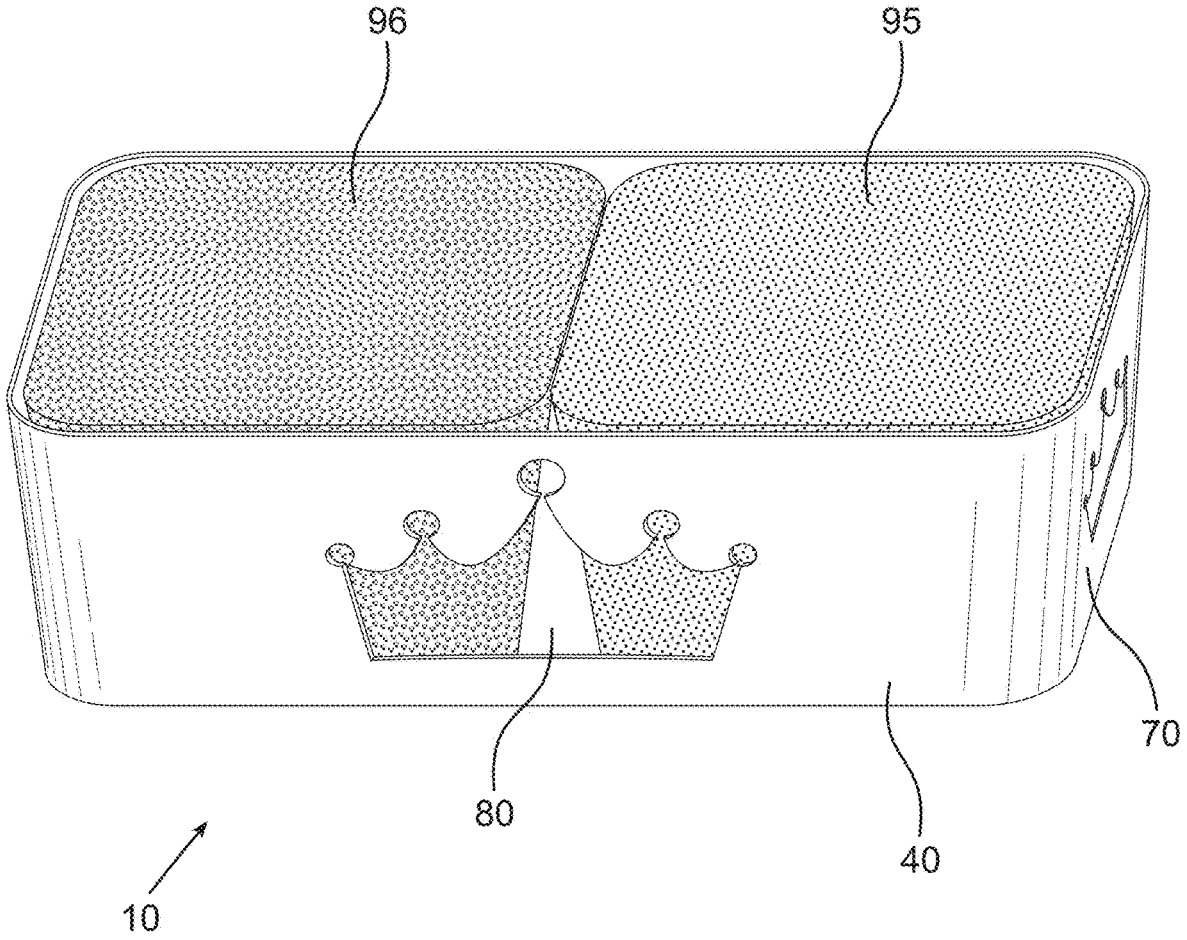
FIG. 32 is a perspective view from the top and side of a large holder holding multiple smaller containers side by side, in accordance with one embodiment.

Holders 10 may be configured to hold multiple containers, for example multiple food containers, for example multiple plastic food containers 95, 96 as shown in FIG. 32. FIG. 32 depicts a larger than average holder 10 into which may fit two medium sized food containers, or into which may fit six smaller food containers, side by side. Accordingly, another embodiment is a holder of nestable transparent or translucent containers in the form of a frame, comprising:

walls 15 including a bottom wall 20; and at least one sloping side wall that slopes from a top of the holder to a bottom of the holder so as to narrow the holder from the top to the bottom, wherein one or more of the walls has a cut-out 80, each of the one or more cut-outs 80 is surrounded by a solid portion of one of the walls 15, the one or more cut-outs 80 shaped so as to allow a user to view contents of one of the containers 95, 96 (FIG. 32) held by the holder 10, wherein a size of the holder 10 matches a size of the nestable plastic containers that the holder 10 holds, the holder 10 configured to hold a first nestable container and a second nestable container side by side such that each of the first and second nestable containers has three sides (i.e. all four sides other than the side that borders the other container) that fit snugly with one of the at least one sloping side walls of the holder 10.

Figure 15:
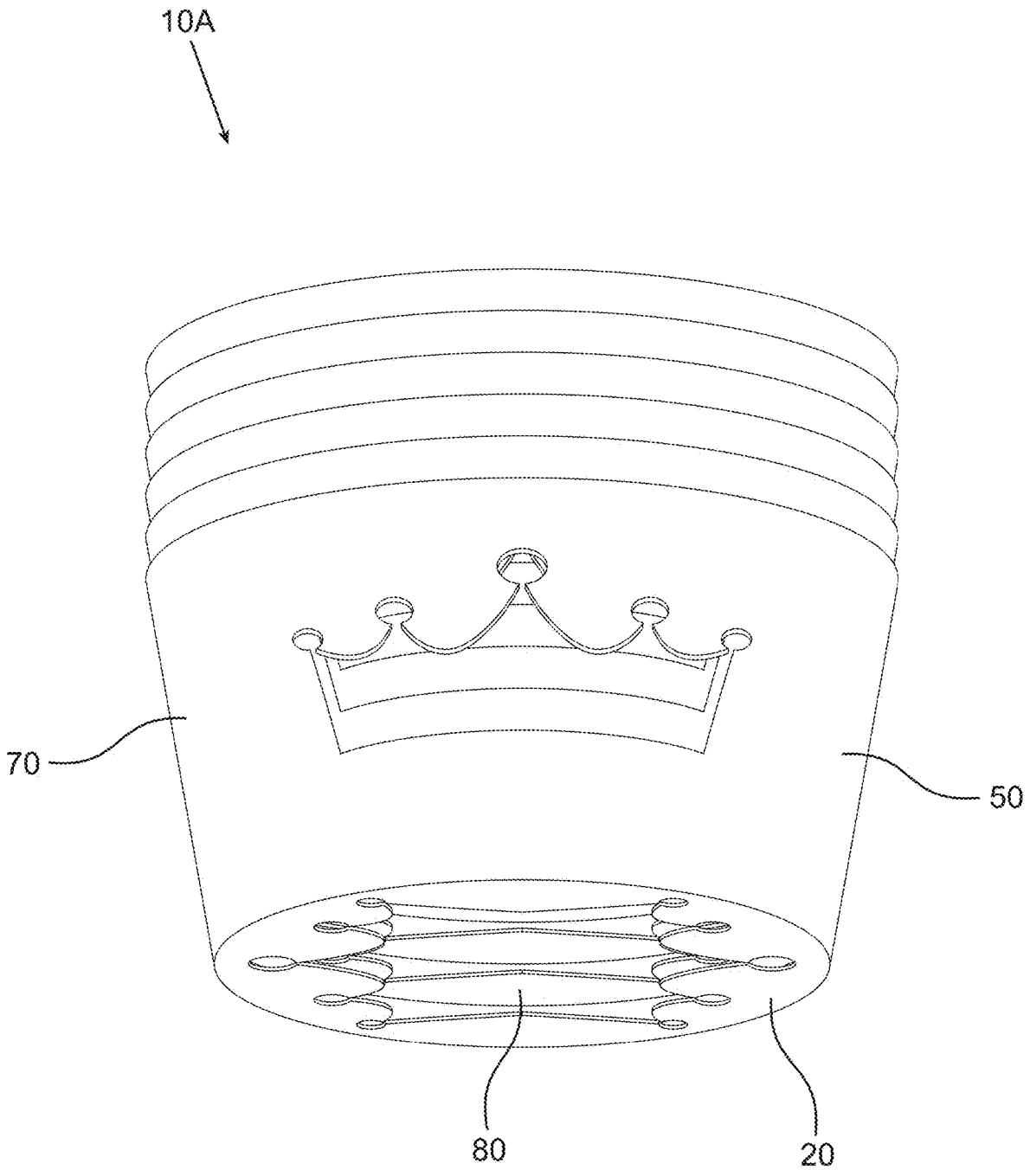
FIG. 15 is a perspective view of a stack of holders of the type shown in FIG. 1, in accordance with one embodiment.

Another embodiment, as seen from FIG. 15, is a stack of nestable holders 10, each of the holders configured in a form of a frame and configured to hold a nestable plastic food container, the stack comprising:

a series of the at least three holders, wherein each holder in the series comprises:

a bottom wall;

at least one sloping side wall;

wherein the bottom wall has a cut-out that occupies a majority of a surface area of the bottom wall, the cut-out 80 shaped so as to (a) define a source identifier associated with the holder and (b) allow a user to view contents of one of the food containers held by any of the holders.

In some implementations, the cut-outs in the walls of the holders in the stack are aligned such that the stack as a whole is configured to be hung by the cut-outs on an element projecting from a wall, the wall and the element not part of the stack, such that the source identifier can be advertised to onlookers while the stack is hung.

Furthermore, even holders 10 of the same shape that are of different sizes (for example different lengths but the same width) can also be stacked and the cut-outs aligned.

In conjunction with any of the embodiments herein, one or more of the cut-outs 80 may be situated at an appropriate height along the walls 15 of holder 10 such that this cut-out or cut-outs 80 is or are configured to receive a handle or two handles of the container that the holder 10 holds nested therein.

Figure 33:
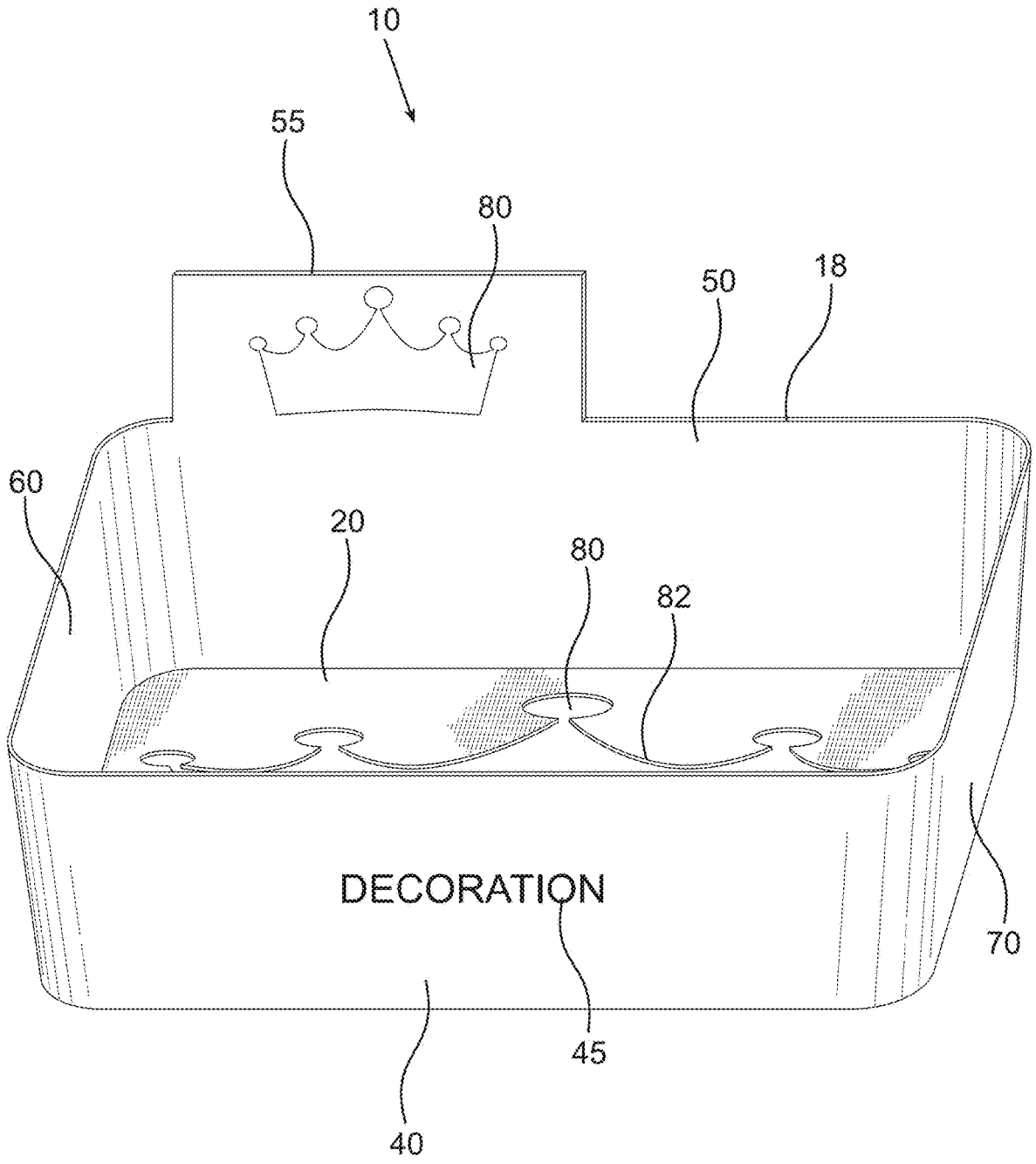
FIG. 33 is a perspective view as in FIG. 1 and showing a decoration layer on one wall of a holder and also showing a wall extension on a second wall, in accordance with one embodiment.

In one particular embodiment, one or more of the side walls 30, 40, 50, 60, 70 of a round or rectangular or square or oval or other-shaped holder 10 wherein the first wall or the second wall is a side wall and comprises a wall extension extending upwardly above a top rim of the holder, and wherein the wall extension 55 includes at least one of the cut-outs or includes the decoration layer 45. One implementation of this is shown in FIG. 33 where wall extension 55 extends wall 50 upward along half a length of wall 50. As shown in FIG. 33, this wall extension 55 may contains a cut-out 80 or a decoration layer 45 just like any other wall 15. In FIG. 33, the only side wall with a cut-out 80 is the wall extension 55 of wall 50.

Figure 31F:
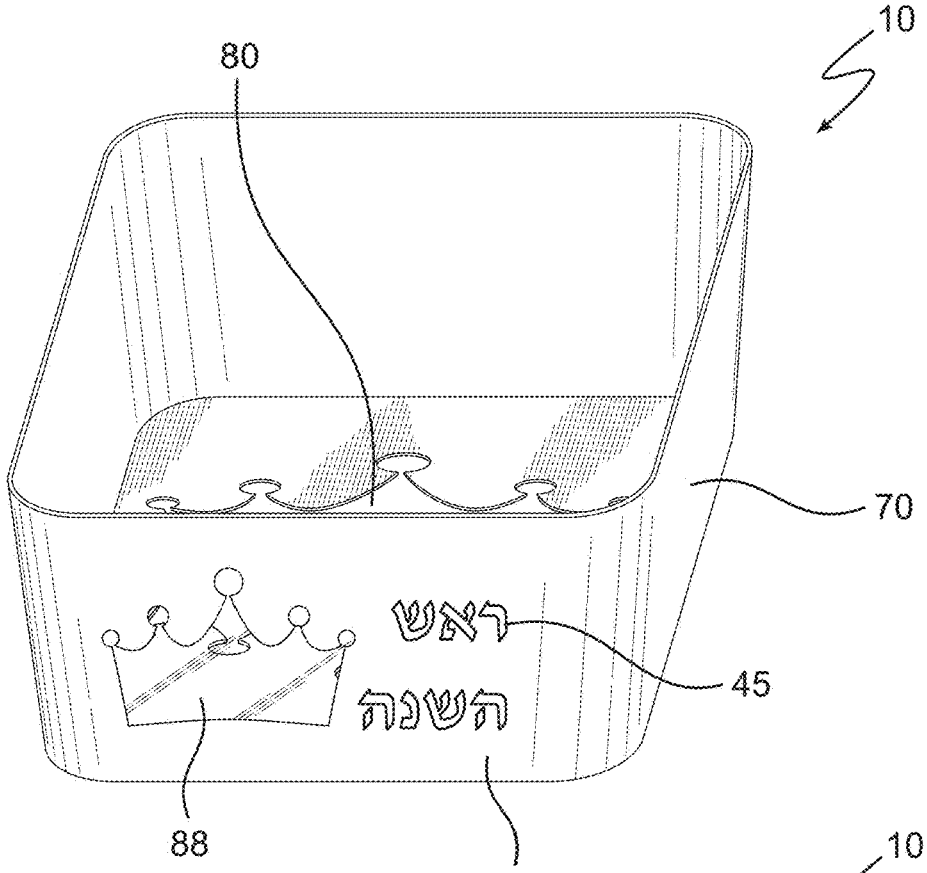
FIG. 31F is a perspective view of a further decoration element having a transparent window, in accordance with one embodiment.
Figure 31G:
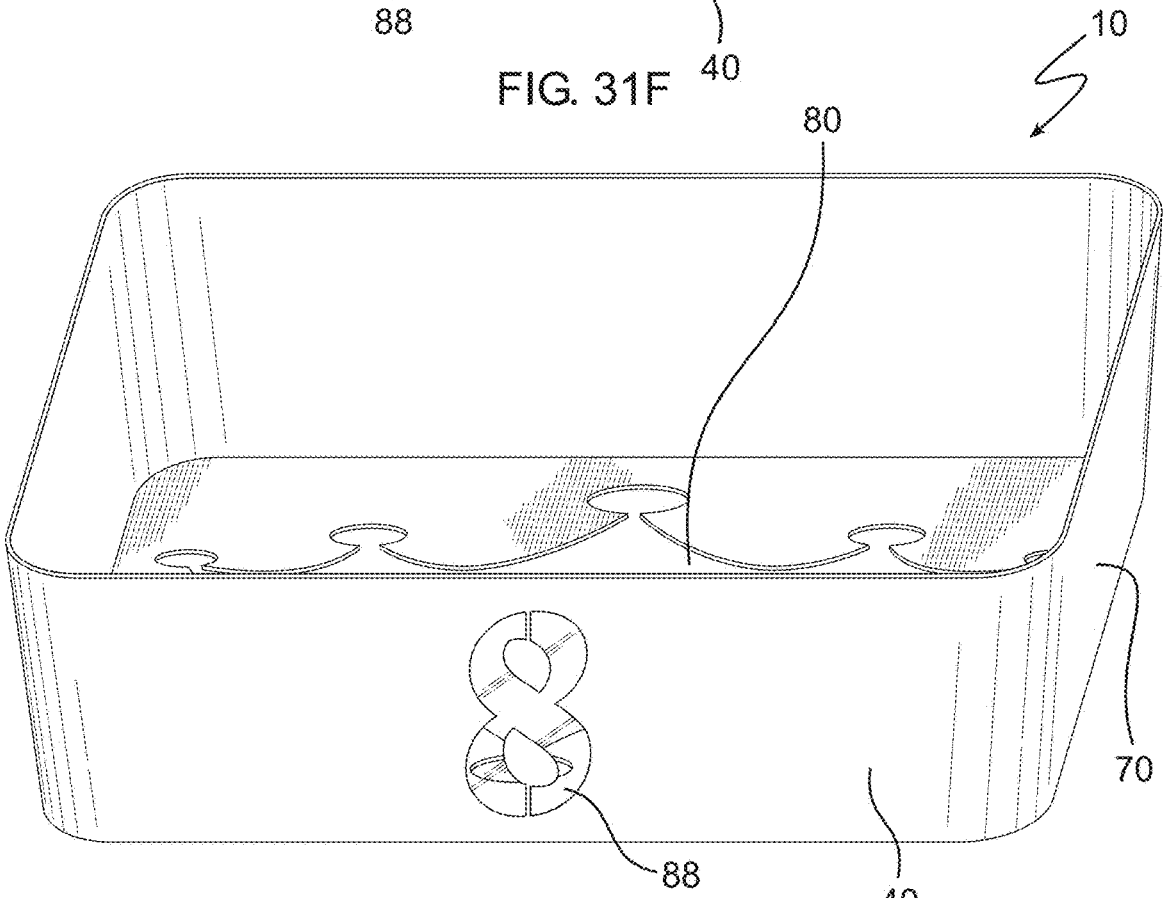
FIG. 31G is a perspective view of a further decoration element having a transparent window, in accordance with one embodiment.

In any embodiment, one of the walls 15 of holder 10 may have a decoration layer 45, as shown by the alphanumeric characters in FIG. 31F. Of course, the particular decoration element 45 shown in FIG. 31F is just a non-limiting example of a decoration layer/element. In FIG. 33, wall 40 has a decoration layer 45, which is not limited to a particular graphic. In general, decoration layer 45 includes a label on a surface of or a graphic on a surface of, one of the walls 15. Alternatively, decoration layer 45 may comprise material, such as a color or a graphic, embedded into a surface of the wall 15 having the decoration layer 45. Thus decoration layer 45 may or may not change the dimensions of the wall 15 that has the decoration layer 45, depending on whether it is embedded in such wall. However, even if the graphic or label of decoration layer 45 is not embedded in the wall, decoration layer is not likely to be a thick layer. Rather it may be as thin as a thin flexible plastic label or as thin as writing material such as ink or any other material used for denoting logos or alphanumeric characters or designs or shapes.

In some implementations of the decoration layer 45, the decoration layer 45 represents an indentation relative to the surrounding surface of the wall.

In any embodiment of holder 10 describe herein, one feature of the holder 10 is that it is elegant. This avoids the need to pour the contents of the various food container(s) into various separate elegant dishes. In one implementation, "elegant" is defined to mean having walls (side and bottom) that are of an elegant color, wherein the elegant colors are: silver, gold, rose gold, platinum, pure white, black, charcoal gray, ivory, cream, navy blue, burgundy, deep plum, blue, purple, violet. Alternatively, the following are defined as elegant finish: matte finish, brushed metal finish.

In any embodiment, the holder may be elegant as a result of the color of the walls and/or the presence on or in the wall or walls of: a decoration layer that is decorative in shape or content and/or one of or more cut-outs or transparent windows that are decorative in shape.

Figure 34:
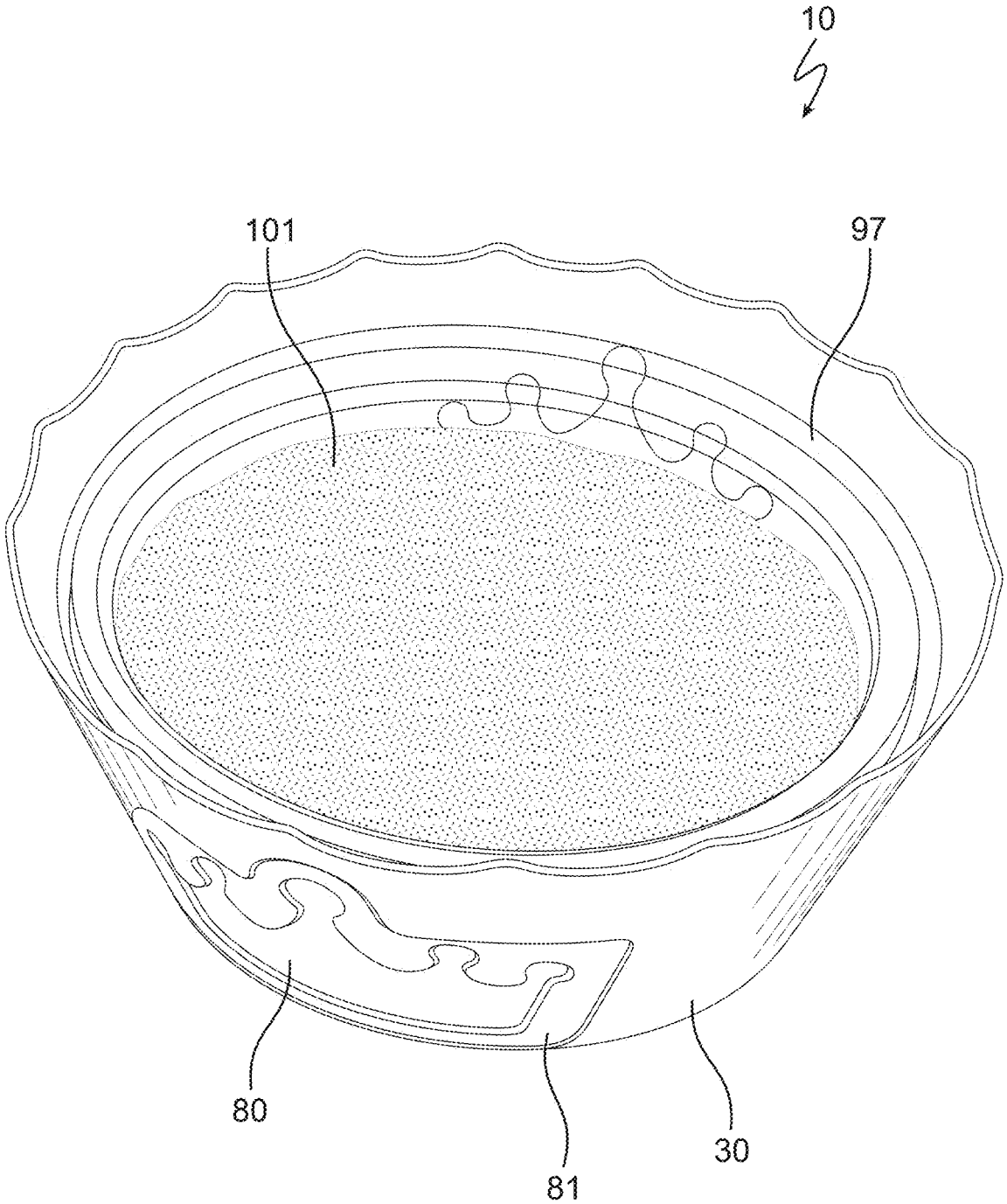
FIG. 34 is a perspective view of a holder with a container nested therein and with salad in the container, in accordance with one embodiment.

Another embodiment is the holder 10, in any implementation or version described herein or claimed herein (including holders 10 with indentations in the bottom wall or any other version of the holder 10) thereof, in combination with a container that the holder 10 holds. An example of this is shown in FIG. 31A where container 92 is held by holder 10 and in FIG. 31B wherein container 98 is held by holder 10. But it is equally applicable to any of the containers referred to herein and not specifically shown where the holders 10 are shown or described. Another example is an elegant holder 10 shown in FIG. 34 that has a container 97 nested within holder 10 and showing a salad 101 (which is a nonlimiting example of a food) within the container 97.

Figure 35A:
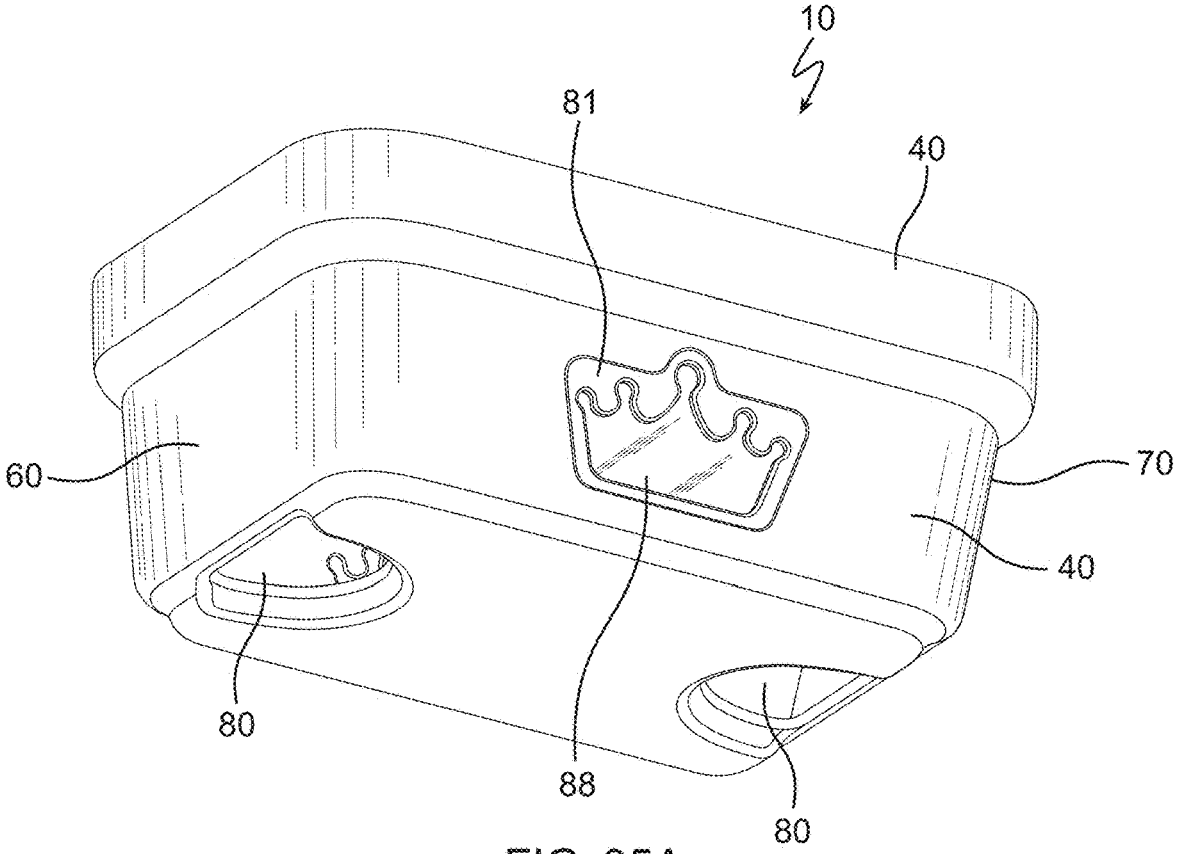
FIG. 35A is a bottom perspective view of a rectangular holder with two side cut-outs in the bottom wall, in accordance with one embodiment.
Figure 35B:
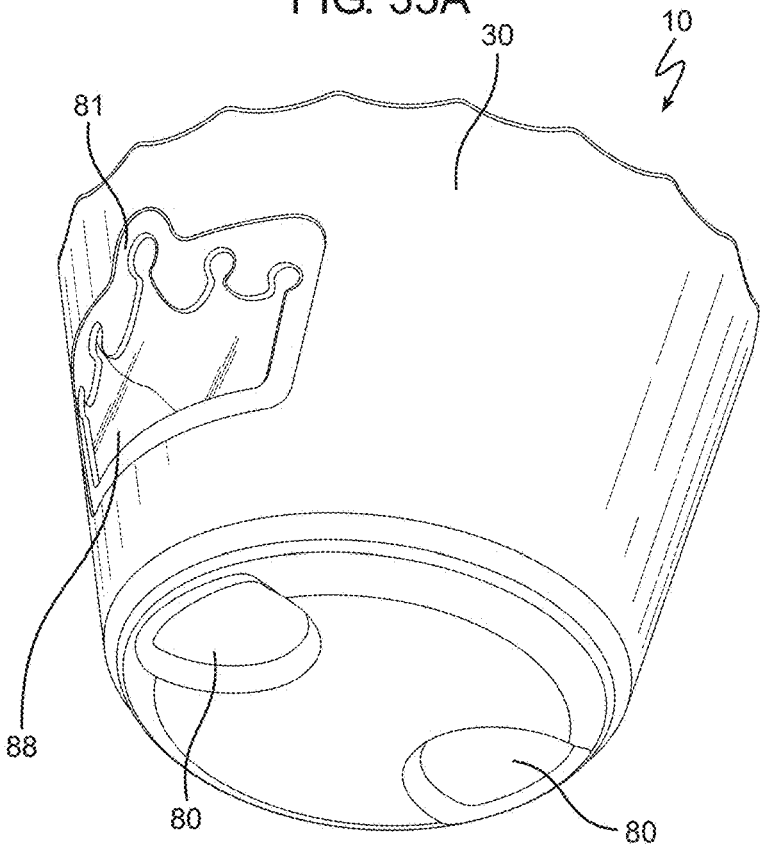
FIG. 35B is a bottom perspective view of a round holder with two side cut-outs in the bottom wall, in accordance with one embodiment.
Figure 37A:
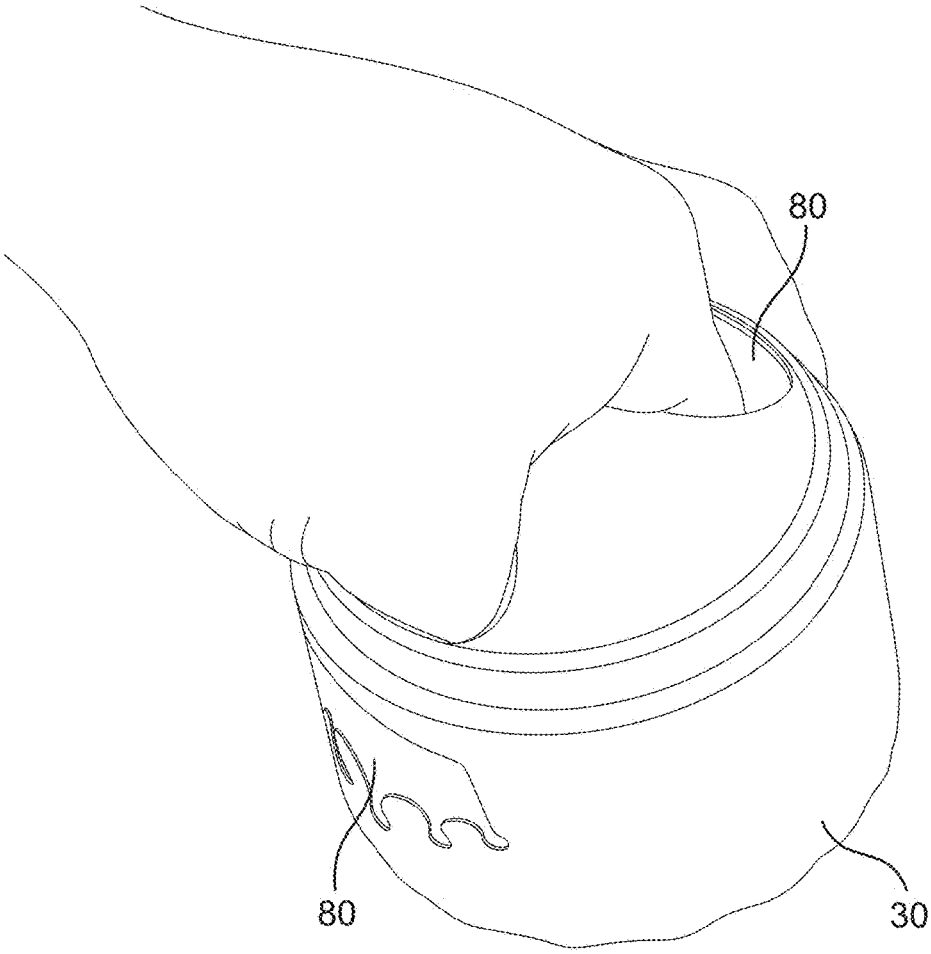
FIG. 37A shows a holder grasped through its bottom cut-outs, in accordance with one embodiment.

FIG. 35A and FIG. 35B show bottom perspective views of rectangular and round (frustoconical) holders 10 respectively in which there are two separated bottom cut-outs 80. A portion of each of the two bottom cut-outs 80 borders the at least one sloping side wall 30 in the case of the round holder 10 of FIG. 35B and in the case of the rectangular holder 10 of FIG. 35A, these cut-outs 80 border two opposite sloping side walls 60, 70 (or in other cases not shown for example two other opposite sloping side walls 40, 50). A user can grasp these cut-outs 80 to eject the container contained within the holder 10, as shown in FIG. 37A. For example, each of the two bottom cut-outs 80 are configured to receive a thumb of a user pressed against a bottom of the container so as to eject the container when the container is nestably held within the holder 10.

Figure 37B:
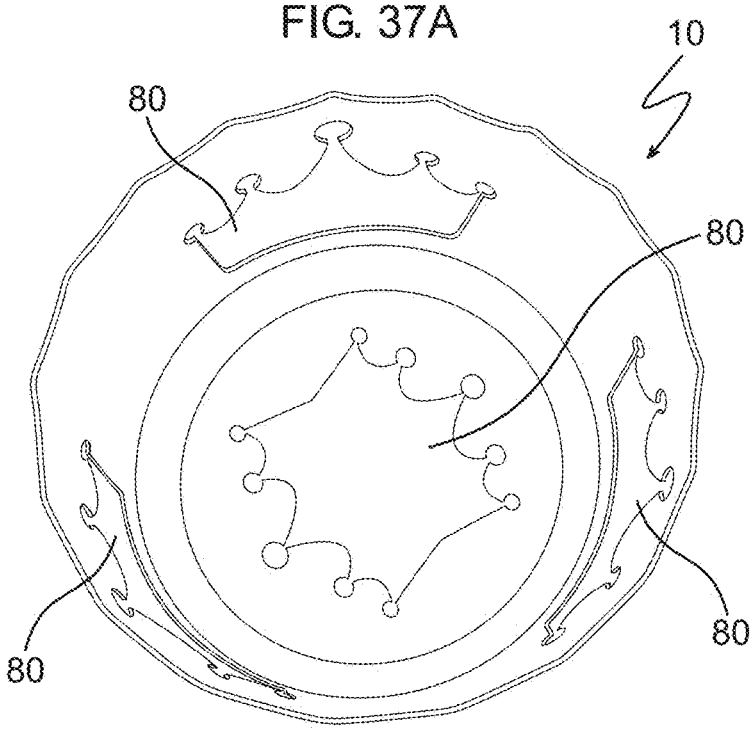
FIG. 37B is a bottom perspective view showing a holder with three side cut-outs and one bottom cut-out, in accordance with one embodiment.
Figure 38:
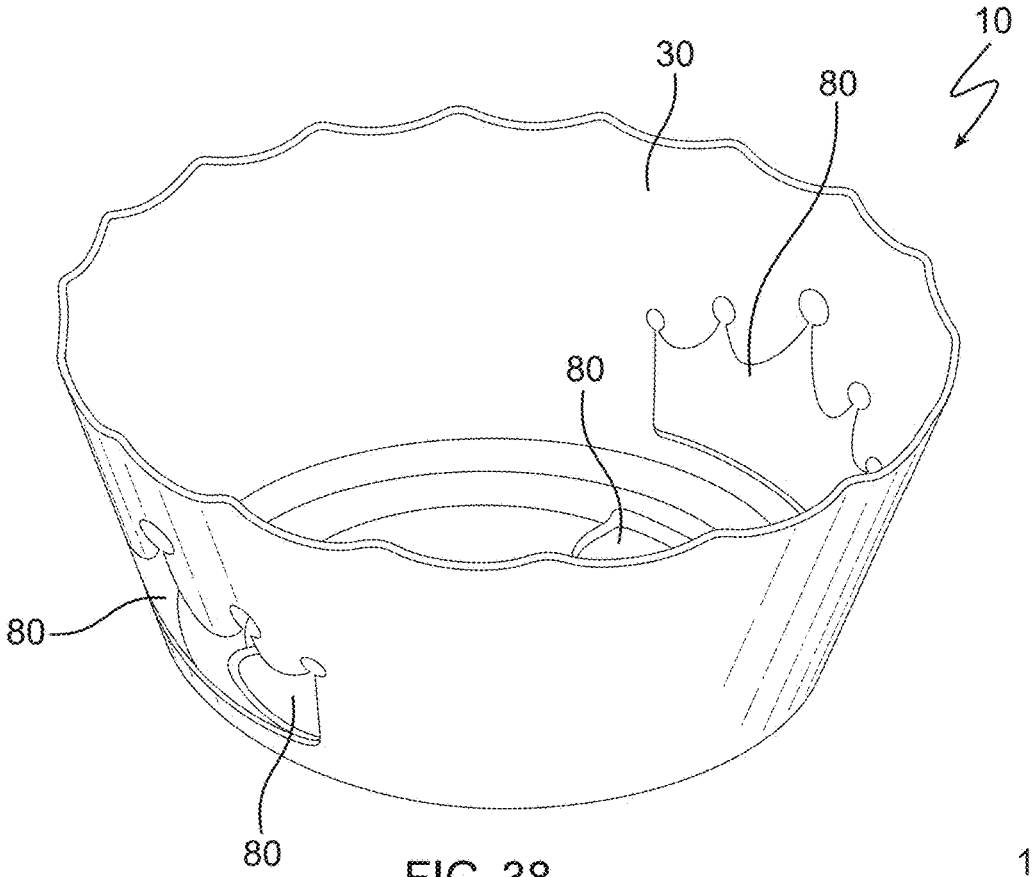
FIG. 38 is a perspective view of a round holder showing a cut-out on the side, in accordance with one embodiment.

FIG. 37B is a bottom perspective view showing a holder 80 with three side cut-outs 80 and one bottom cut-out 80. Of course, a rectangular holder 10 or a holder 10 of another shape may have two or three or four or more cut-outs 80 (or transparent windows 88 and/or decoration layers 45) on the side walls (30, 40, 50 60, 70) thereof, and the bottom wall 20 may have one or two (or more) cut-outs 80 (or transparent windows 88 and/or decoration layers 45) also. The shape of the cut-outs 80 or transparent windows 88 does not have to be crowns or even have to resemble crowns.

Furthermore, in any embodiment of holder 10, the cut-outs 80 or transparent windows 88 (or decoration layers 45 or decoration elements of decoration layers 45) do not have to be identical to one another, although there are identical to one another in some embodiments. In some embodiments, only all cut-outs 80 or transparent windows 88 or decoration layers 45 in the one or more sloping side walls (30, 40, 50, 60, 70) are identical to one another.

Figure 39:
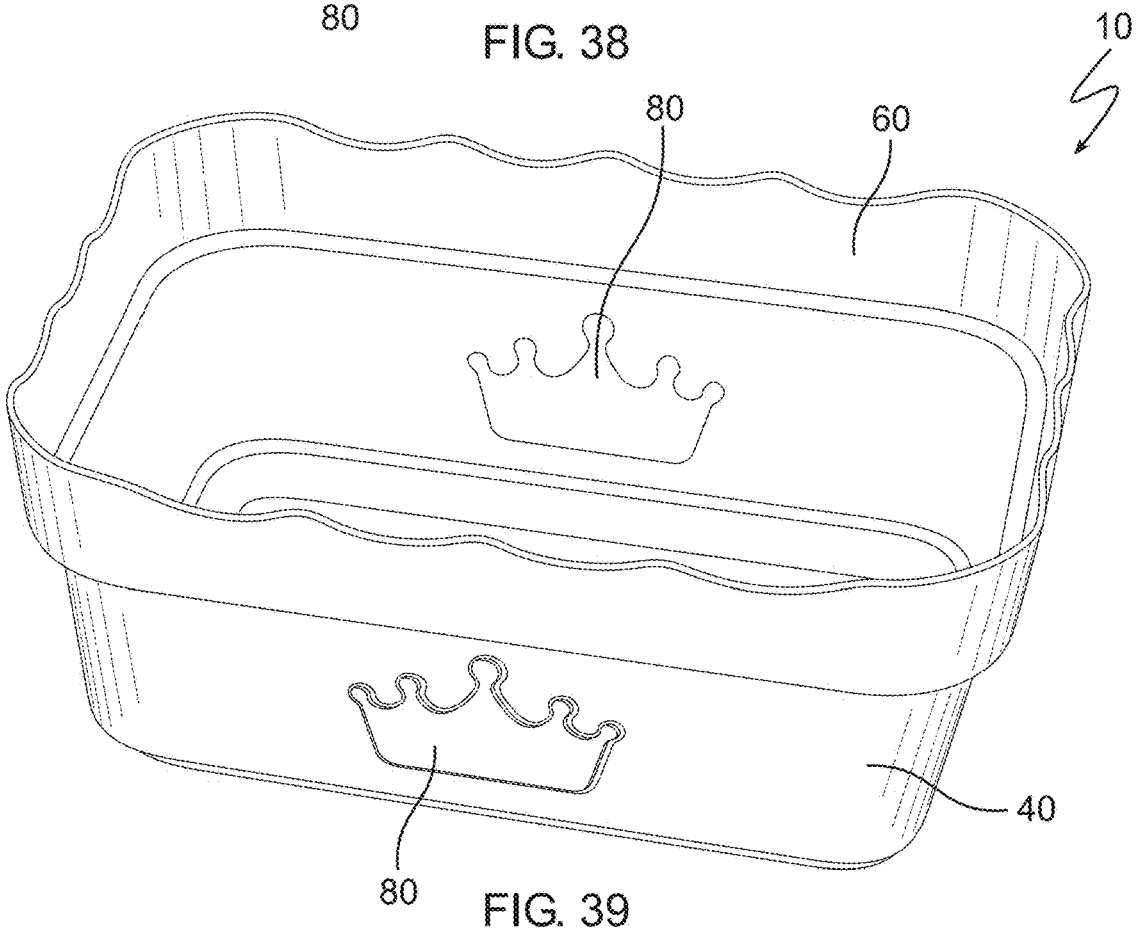
FIG. 39 is a perspective view as in FIG. 38 but of a rectangular holder, in accordance with one embodiment.

As shown in FIG. 39, each of the two bottom cut-outs 80 are configured to receive a thumb (or other finger) of a user so as to allow the user to grasp and carry a stack of the holders 10. This is in contrast to the side wall cut-outs 80 in which typically one or more cut-outs 80 in the at least one sloping side wall is surrounded by a solid portion of the at least one sloping side wall not bordering the bottom wall.

Figure 36A:
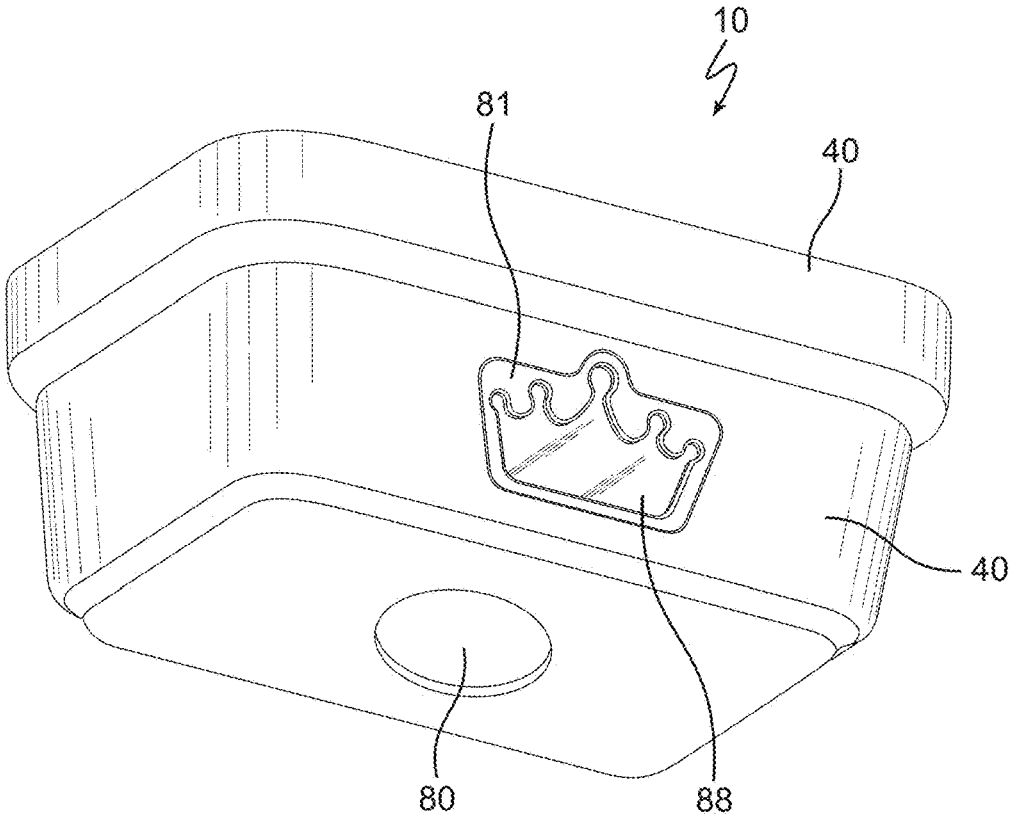
FIG. 36A is a bottom perspective view of a rectangular holder with one central cut-out in the bottom wall, in accordance with one embodiment.
Figure 36B:
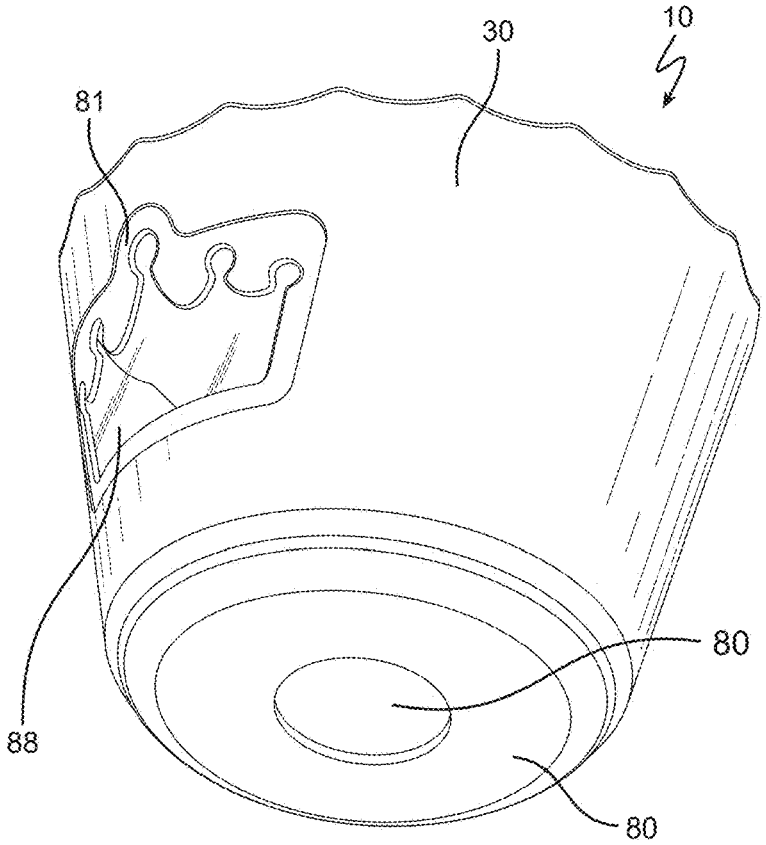
FIG. 36B is a bottom perspective view of a round holder with one central cut-out in the bottom wall, in accordance with one embodiment.

FIG. 36A and FIG. 36B show bottom perspective views of rectangular and round (frustoconical) holders 10 respectively in which there is central bottom cut-out 80. A user can grasp this cut-outs 80 to eject the container contained within the holder 10.

In some embodiments, the at least one sloping side wall (or the bottom wall) also includes a decoration layer 45 that includes a label or graphic on a surface of, or embedded into a surface of, the at least one sloping wall. The decoration layer 45 may include one of the one or more transparent windows 88.

In some embodiments, as shown in FIG. 35A-B (rectangular holder) and FIG. 36A-B (round holder), a transparent window, for example a side wall transparent window 88 may be surrounded by an indented area 81 of the wall such that the border of the indented area 81 has a contour similar to the outer border or contour of the transparent window 88.

If the holder includes a decoration layer 45, in come embodiments, at least a portion of the decoration layer 45 may be indented relative to a surface of the at least one sloping side wall (or of the bottom wall). The decoration layer 45 may include one or more source identifiers 80.

In any embodiment, the at least one sloping side wall (or some or all of the walls of holder 10) is colored with or of one of the following elegant colors: silver, gold, rose gold, platinum, pure white, pure black, charcoal gray, ivory, cream, navy blue, burgundy, deep plum, blue, purple and violet. This provides an elegant appearance for the presentation of the food inside the container which inside the holder 10. Often, the container snugly nested within the holder 10 is not visible. As a result, the appearance of the entire food plus container plus holder 10 is much more elegant than it would be if the food were merely presented inside a plastic food container.

Figure 40:
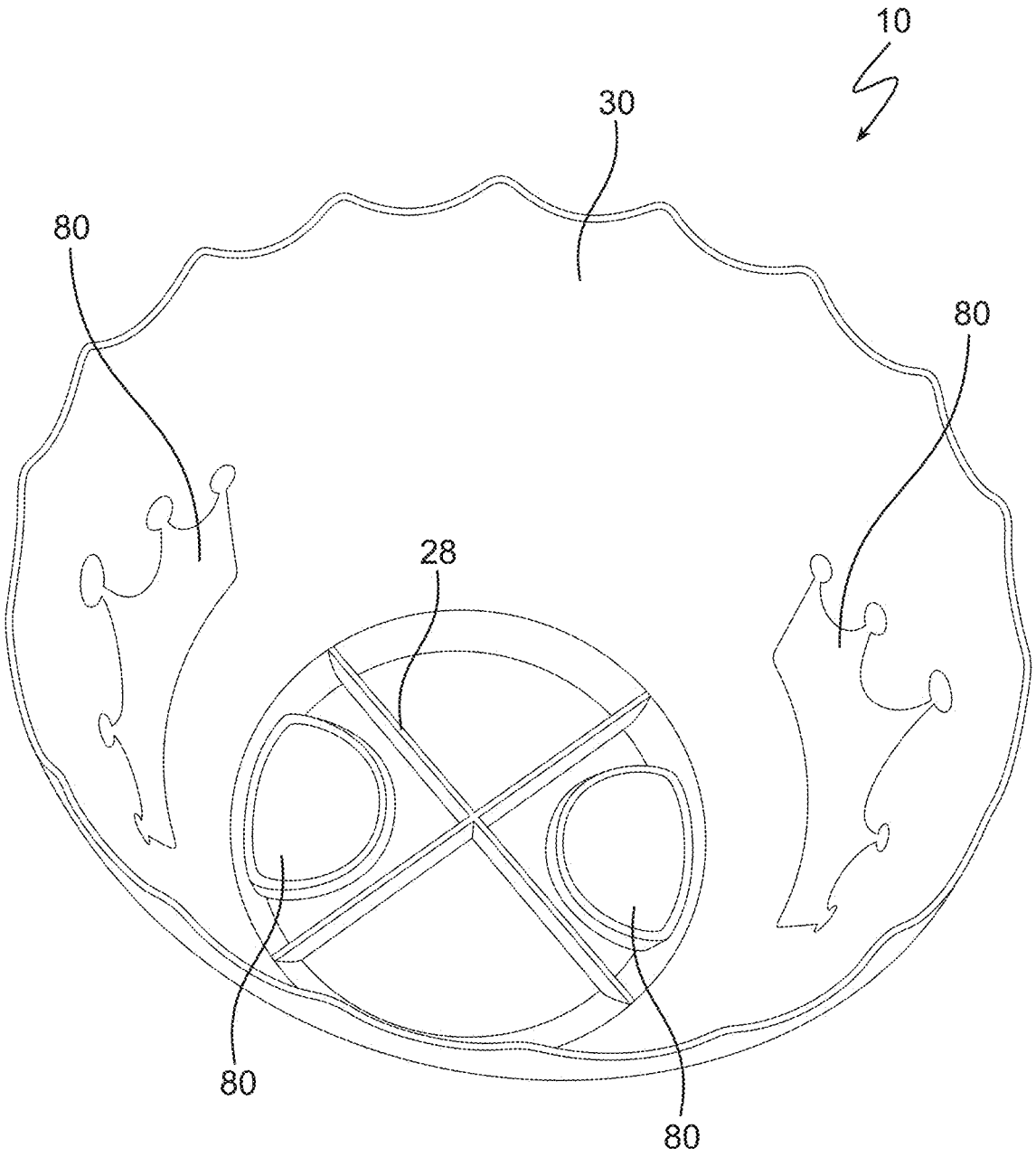
FIG. 40 is a perspective view of an elegant round holder with two bottom wall cut-outs and a protrusion on the bottom wall, in accordance with one embodiment.
Figure 41:
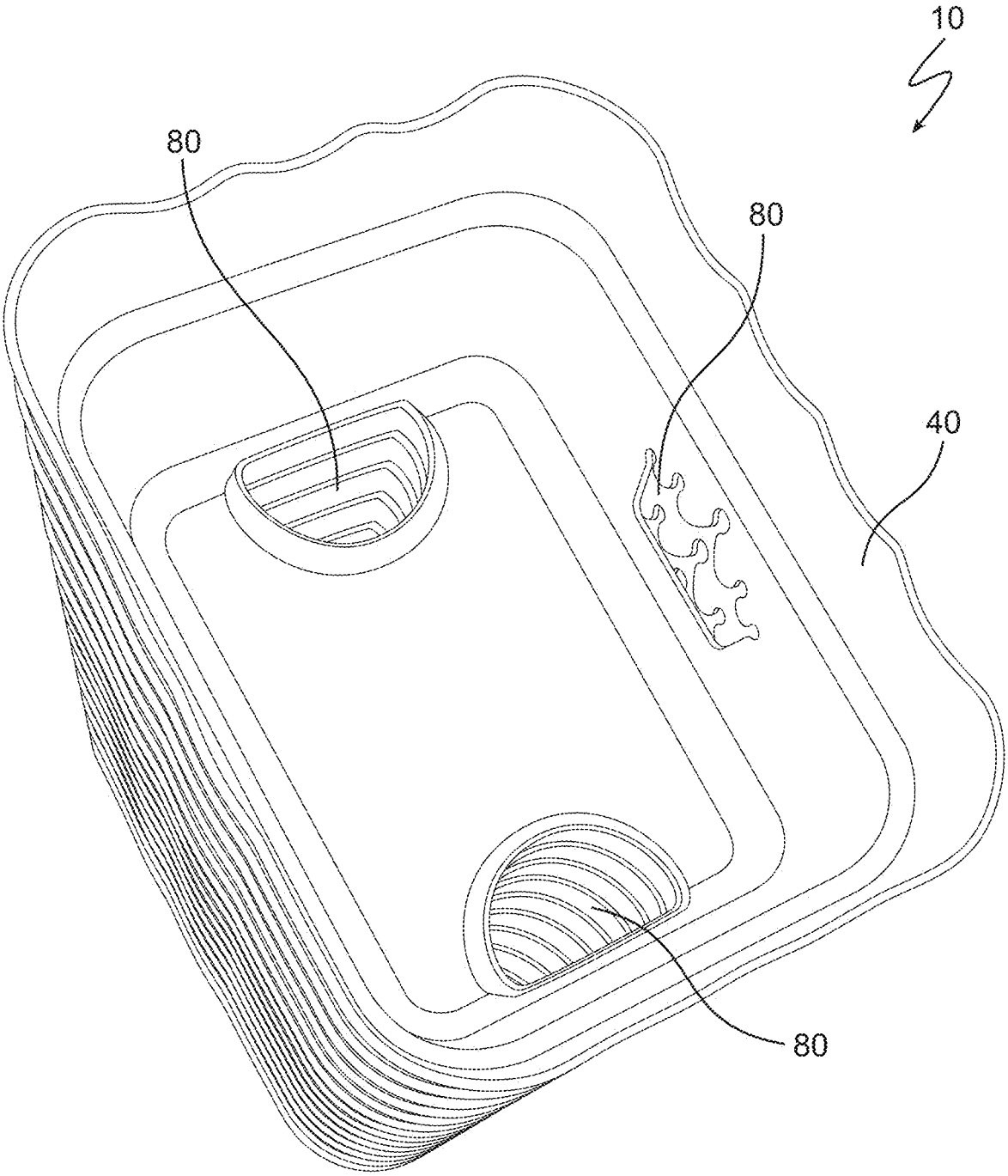
FIG. 41 is a perspective view of a stack of holders each having two bottom wall cut-outs, in accordance with one embodiment.

In any embodiment, the bottom wall 20 of the holder 10 may have a protrusion projecting from it, for example a protrusion 28 in the shape of an "X", as shown in FIG. 40.

Another embodiment is a holder configured to nestably hold a container, comprising walls including a bottom wall;

at least one sloping side wall that slopes from a top of the holder to a bottom of the holder so as to narrow the holder from the top to the bottom;

wherein a first wall of the walls includes one or more cut-outs configured to allow a user to see a contents of the container, wherein the first wall or a second wall of the walls includes a decoration layer that includes a label or graphic on a surface of, or embedded into a surface of, the first wall or the second wall, wherein a size of the holder matches a size of the container such that the holder is configured to hold the container nesting inside the holder.

While the invention has been described with respect to a limited number of embodiments, it will be appreciated that many variations, modifications and other applications of the invention may be made. Therefore, the claimed invention, as recited in the claims that follow, is not limited to the embodiments described herein.

What is claimed is:

1. A holder configured to nestably hold a container, comprising:

a bottom wall with at least one bottom wall cut-out;

at least one sloping side wall that slopes from a top of the holder to a bottom of the holder so as to narrow the holder from the top to the bottom;

wherein the at least one sloping side wall includes one or two or three side wall cut-outs, or one or more transparent windows and the one or two or three side wall cut-outs, that are configured to allow a user to see a content of the container, wherein at least one of the one or two or three side wall cut-outs is shaped as a crown having a substantially horizontal base from which a series of two or more upward-projecting elements extend so as to form projections along an upper edge, the projections comprise alternating peaks and valleys or alternating circles and indentations, the crown having bilateral symmetry along a central vertical axis, wherein each particular sloping side wall of the at least one sloping side wall forms a continuous wall, wherein if the holder is not substantially round or substantially frustoconical, the continuous wall formed by each particular sloping side wall has no more than one side wall cut-out of the one or two or three side wall cut-outs;

wherein each of the side wall cut-outs of the one or two or three side wall cut-outs is not adjacent an edge of the continuous wall of any particular sloping side wall.

2. The holder of claim 1, wherein the at least one sloping side wall includes the one or two or three side wall cut-outs and wherein the at least one bottom wall cut-outs comprise two bottom wall cut-outs that are separated from one another, wherein a portion of each of the two bottom wall cut-outs borders the at least one sloping side wall.

3. The holder of claim 2, wherein each of the two bottom wall cut-outs are configured to receive a thumb of a user pressed against a bottom of the container so as to eject the container when the container is nestably held within the holder.

4. The holder of claim 2, wherein each of the two bottom wall cut-outs are configured to receive a thumb of a user so as to allow the user to grasp and carry a stack of the holders.

5. The holder of claim 2, wherein the at least one sloping side wall includes the one or two or three side wall cut-outs and the one or two or three side wall cut-outs are surrounded by a solid portion of the at least one sloping side wall.

6. The holder of claim 1, wherein the at least one sloping side wall also includes a decoration layer that includes a label or graphic on a surface of, or embedded into a surface of, the at least one sloping wall.

7. The holder of claim 6, wherein the decoration layer includes one of the one or more transparent windows.

8. The holder of claim 6, further comprising an area adjacent the decoration layer or included in the decoration layer is indented relative to a surface of the at least one sloping side wall or of the bottom wall.

9. The holder of claim 1, wherein the at least one sloping side walls includes the one or more transparent windows.

10. The holder of claim 1, wherein the at least one sloping side wall is colored with one of the following elegant colors: silver, gold, rose gold, platinum, pure white, pure black, charcoal gray, ivory, cream, navy blue, burgundy, deep plum, blue, purple and violet.

11. The holder of claim 1, wherein each particular side wall cut-out of the one or two or three side wall cut-outs occupies at least 25% of a surface area of a particular sloping side wall of the at least one sloping side wall that the particular side wall cut-out is cut out of.

12. The holder of claim 1, wherein each sloping side wall of the at least one sloping side wall slopes at an angle of up to 25 degrees to a vertical axis orthogonal to the bottom wall.

13. The holder of claim 1, wherein the at least one sloping side wall slope nonlinearly.

14. The holder of claim 1, wherein the at least one sloping side wall has one or more of the cut-outs configured to receive a handle of the container.

15. The holder of claim 1, wherein the bottom wall has an indentation configured to snugly receive a bottom of a container.

16. The holder of claim 1, wherein the one or two or three side wall cut-outs include one or both of the following:

(i) multiple identical cut-outs cut out of one of the walls, (ii) an alphanumeric character, single or double crowns, a heart, a diamond, a celestial object, a human or animal figure, a flower, a dollar sign.

17. The holder of claim 1, wherein the holder is configured to hold a first nestable container and a second nestable container side by side such that each of the first and second nestable containers has three sides that fit snugly with one of the at least one sloping side walls of the holder.

18. A combination of the holder of claim 1 and the container nesting inside the holder.

19. The holder of claim 1, wherein the at least one sloping side wall comprises one particular sloping side wall that is substantially round or substantially frustoconical, and wherein each of the side wall cut-outs of the particular sloping side wall are substantially identical to one another.

20. The holder of claim 1, wherein at least one of the one or two or three side wall cut-outs has a geometric configuration that is inherently distinctive enough to visually correspond to a brand associated with an origin of, or a seller of, the holder.

21. The holder of claim 1, wherein at least one of the one or two or three side wall cut-outs spells out a word.

22. The holder of claim 1, wherein for the particular sloping side wall that is substantially round or substantially frustoconical, the continuous wall has not more than two side wall cut-outs of the one or two or three side wall cut-outs.

23. The holder of claim 1, wherein for the particular sloping side wall that is substantially round or substantially frustoconical, the continuous wall has not more than one side wall cut-outs of the one or two or three side wall cut-outs.

24. The holder of claim 1, wherein for the particular sloping side wall that is substantially round or substantially frustoconical, there are two side wall cut-outs of the one or two or three side wall cut-outs and each of the two side wall cut-outs is entirely in a different hemisphere of the holder, wherein the hemispheres are defined by cutting the holder into the two hemispheres along a vertical plane when the bottom wall of the holder rests on a surface.

* * * * *